US010297098B2

(12) United States Patent
Nishida et al.

(10) Patent No.: US 10,297,098 B2
(45) Date of Patent: May 21, 2019

(54) PAPER SHEET STORAGE APPARATUS AND STORING METHOD OF PAPER SHEET STORAGE APPARATUS

(71) Applicant: FUJITSU FRONTECH LIMITED, Inagi (JP)

(72) Inventors: Mitsutaka Nishida, Inagi (JP); Hayato Minamishin, Inagi (JP); Naoto Ikeda, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 15/943,174

(22) Filed: Apr. 2, 2018

(65) Prior Publication Data

US 2018/0225903 A1 Aug. 9, 2018

Related U.S. Application Data

(63) Continuation of application No. PCT/JP2015/080414, filed on Oct. 28, 2015.

(51) Int. Cl.
*B65H 31/24* (2006.01)
*B65H 31/30* (2006.01)
(Continued)

(52) U.S. Cl.
CPC ..... *G07D 11/0012* (2013.01); *B65H 29/20* (2013.01); *B65H 29/40* (2013.01); *B65H 31/10* (2013.01); *B65H 31/24* (2013.01); *B65H 31/3054* (2013.01); *B65H 39/115* (2013.01); *B65H 43/00* (2013.01); *G07D 9/00* (2013.01); *G07D 11/0006* (2013.01);
(Continued)

(58) Field of Classification Search
CPC ..... B65H 31/24; B65H 31/3009; B65H 31/3018; B65H 31/32; B65H 2701/1912; B65H 2405/331; B65H 2301/42264; B65H 2301/4228; G07D 11/0012; G07D 11/0006
See application file for complete search history.

(56) References Cited

U.S. PATENT DOCUMENTS 3,236,162 A 2/1966 Reist
5,240,245 A 8/1993 Ademmer et al.
(Continued)

FOREIGN PATENT DOCUMENTS

JP 51-51395 5/1976
JP 61-291363 12/1986
(Continued)

OTHER PUBLICATIONS

International Search Report dated Dec. 15, 2015 in corresponding International Patent Application No. PCT/JP2015/080414.
(Continued)

*Primary Examiner* — Luis A Gonzalez
(74) *Attorney, Agent, or Firm* — Staas & Halsey LLP

(57) ABSTRACT

A apparatus includes a storage mechanism that includes a plurality of storage spaces where paper sheets are stored and continuously feeds out the storage spaces toward one direction while creating the storage spaces one by one, an alignment mechanism that carries banknotes into the storage spaces in the order that the storage mechanism feeds out the storage spaces, and a controller that controls the alignment mechanism and the storage mechanism.

6 Claims, 18 Drawing Sheets

(51) Int. Cl.

| | |
|---|---|
| ***G07D 11/00*** | (2019.01) |
| ***G07D 9/00*** | (2006.01) |
| ***B65H 29/20*** | (2006.01) |
| ***B65H 43/00*** | (2006.01) |
| ***B65H 29/40*** | (2006.01) |
| ***B65H 31/10*** | (2006.01) |
| ***B65H 39/115*** | (2006.01) |

(52) U.S. Cl.
CPC ..... *G07D 11/0009* (2013.01); *G07D 11/0018* (2013.01); *G07D 11/0027* (2013.01); *G07D 11/0051* (2013.01); *B65H 2301/42264* (2013.01); *B65H 2301/4318* (2013.01); *B65H 2405/3311* (2013.01); *B65H 2405/351* (2013.01); *B65H 2405/361* (2013.01); *B65H 2408/113* (2013.01); *B65H 2701/1912* (2013.01); *G07D 2211/00* (2013.01)

(56) References Cited

U.S. PATENT DOCUMENTS

| | | | | |
|---|---|---|---|---|
| 5,735,519 | A | 4/1998 | Ozawa et al. | |
| 9,950,890 | B2 * | 4/2018 | Koo | B65H 31/06 |
| 2004/0256784 | A1 | 12/2004 | Nomiyama et al. | |
| 2009/0166948 | A1 | 7/2009 | Yui | |

FOREIGN PATENT DOCUMENTS

| | | |
|---|---|---|
| JP | 4-503727 | 7/1992 |
| JP | 2002-321862 | 11/2002 |
| JP | 2005-10967 | 1/2005 |
| JP | 2005145596 | 6/2005 |
| JP | 2007-290850 | 11/2007 |
| JP | 2011054058 | 3/2011 |
| JP | 2014-109797 | 6/2014 |
| WO | WO 2013/014698 A1 | 1/2013 |

OTHER PUBLICATIONS

Written Opinion of the International Searching Authority dated Dec. 15, 2015 in corresponding International Patent Application No. PCT/JP2015/080414.

Extended European Search Report, dated Oct. 9, 2018, in European Application No. 15907245.3 (7 pp.).

* cited by examiner

PAPER SHEET STORAGE APPARATUS AND STORING METHOD OF PAPER SHEET STORAGE APPARATUS

CROSS-REFERENCE TO RELATED APPLICATION

This application is a continuation application of International Application PCT/JP2015/080414, filed on Oct. 28, 2015 and designating the U.S., the entire contents of which are incorporated herein by reference.

FIELD

The present invention relates to a paper sheet storage apparatus and a storing method of the paper sheet storage apparatus.

BACKGROUND

Some banknote handling apparatuses used as, for example, an automated teller machine (ATM) include banknote storage apparatuses that store banknotes collected from the banknote handling apparatuses. This type of the banknote storage apparatus includes, for example, a carry-in mechanism for carrying in banknotes and a storage mechanism having a storage space that stores banknotes carried in by the carry-in mechanism.

As a banknote storage apparatus of related art, a configuration is known in which the storage space for storing banknotes is divided into two spaces and the banknotes are stored by being pushed into the respective storage spaces by the storage mechanism.

Patent Literature 1: International Publication Pamphlet No. WO 2013/014698

Incidentally, in order to efficiently collect the banknotes stored in the banknote storage apparatus, it is desirable to secure a large storage space for storing banknotes. When the large storage space is secured, the banknotes are sequentially stored from one end side to the other end side in one storage space. In this case, for example, a storage mechanism that pushes banknotes from one end side of the storage space into the storage space and that stores them, is used such as the banknote storage apparatus of related art. In such a storage mechanism, when a plurality of types of banknotes with different sizes are mixed and stored in the storage space, there is a possibility of occurrence of so-called jamming, in which the banknotes collide with each other and become clogged at the time of pushing the banknotes into the storage space.

Therefore, a configuration is proposed in which the whole of the secured large storage space is divided to provide a plurality of storage spaces and banknotes are carried in each storage space. However, in the configuration that has a plurality of storage spaces, a carry-in mechanism, which includes carry-in paths for carrying banknotes into and storing them in the storage spaces, is provided in each storage space. For this reason in the configuration using the storage spaces, a space occupied by the carry-in mechanism with respect to the inner space of the banknote storage apparatus is increased, and the inner space is not effectively used as the storage space, which makes it difficult to efficiently store the banknotes in the inner space.

SUMMARY

According to an aspect of the embodiments, a paper sheet storage apparatus includes: a storage mechanism that includes a plurality of storage spaces where paper sheets are stored, and continuously feeds out the storage spaces toward one direction while creating the storage spaces one by one; a carry-in mechanism that carries the paper sheets into the storage spaces in the order that the storage mechanism feeds out the storage spaces; and a controller that controls the carry-in mechanism and the storage mechanism.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Exemplary embodiments of the paper sheet storage apparatus and the storing method of the paper sheet storage apparatus disclosed in the present application, will be explained in detail below with reference to the accompanying drawings. It is to be noted that the embodiments below are not intended to limit the paper sheet storage apparatus and the storing method of the paper sheet storage apparatus disclosed in the present application.

Embodiments

Configuration of Banknote Handling Apparatus

Figure 1:
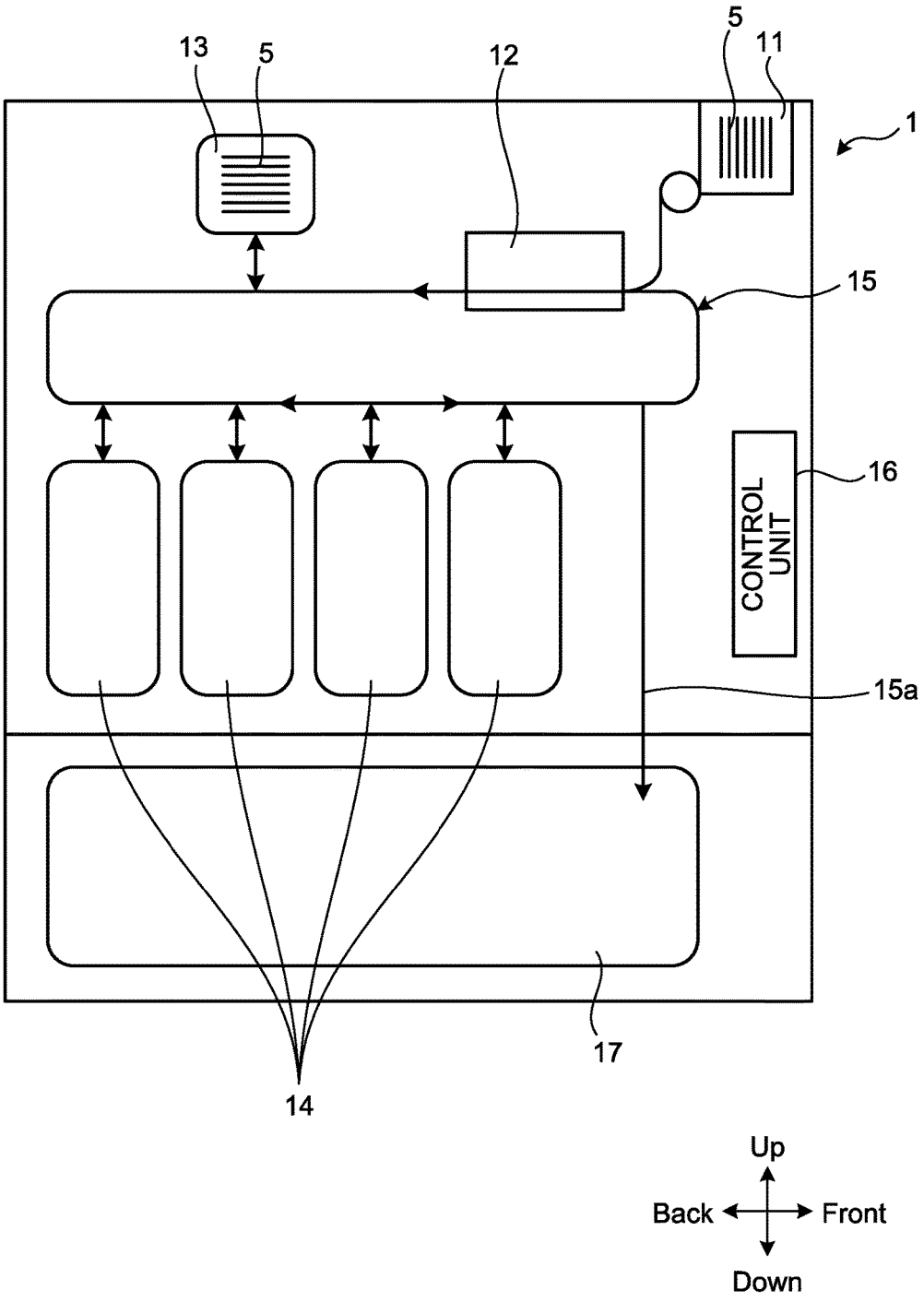
FIG. 1 is a schematic diagram illustrating the entire banknote handling apparatus including a banknote storage apparatus of an embodiment.

FIG. 1 is a schematic diagram illustrating the entire banknote handling apparatus including a banknote storage apparatus of an embodiment. In the figures after FIG. 1, the up-down direction, the front-back direction, and left-right direction of the banknote handling apparatus are indicated by arrows. As illustrated in FIG. 1, a banknote handling apparatus 1 according to the embodiment includes a receipt/payment unit 11 that receives/pays banknotes 5, and a distinction unit 12 that distinguishes the banknotes 5 received from the receipt/payment unit 11. The banknote handling apparatus 1 also includes a holding unit 13 that temporarily holds the banknotes 5 conveyed from the distinction unit 12, a plurality of housing units 14 that house the banknotes 5 conveyed from the holding unit 13, a conveying unit 15 that conveys the banknotes 5, and a controller 16 that controls the units 11 to 15. The conveying unit 15 includes a plurality of conveying rollers 15*b* (see FIG. 2) arranged along a conveying path 15*a* of the banknotes 5 and a drive mechanism (not illustrated) that drives the conveying rollers 15*b*.

The banknote handling apparatus 1 also includes a storage unit 17 that stores the banknotes 5 sent from the housing units 14 in order to collect the banknotes 5 from the banknote handling apparatus 1. The storage unit 17 incorporated in the banknote handling apparatus 1, corresponds to the banknote storage apparatus of the embodiment and corresponds to a collection box that stores the banknotes 5 collected from the banknote handling apparatus 1. Hereinafter, the storage unit 17 of the banknote handling apparatus 1 will be explained as a banknote storage apparatus 17. Moreover, although the banknotes 5 are used as an example of paper sheets in the present embodiment, the embodiment is not limited to the banknotes 5, and, therefore, other paper sheets such as cash vouchers may be used.

Configuration of Banknote Storage Apparatus

Figure 2:
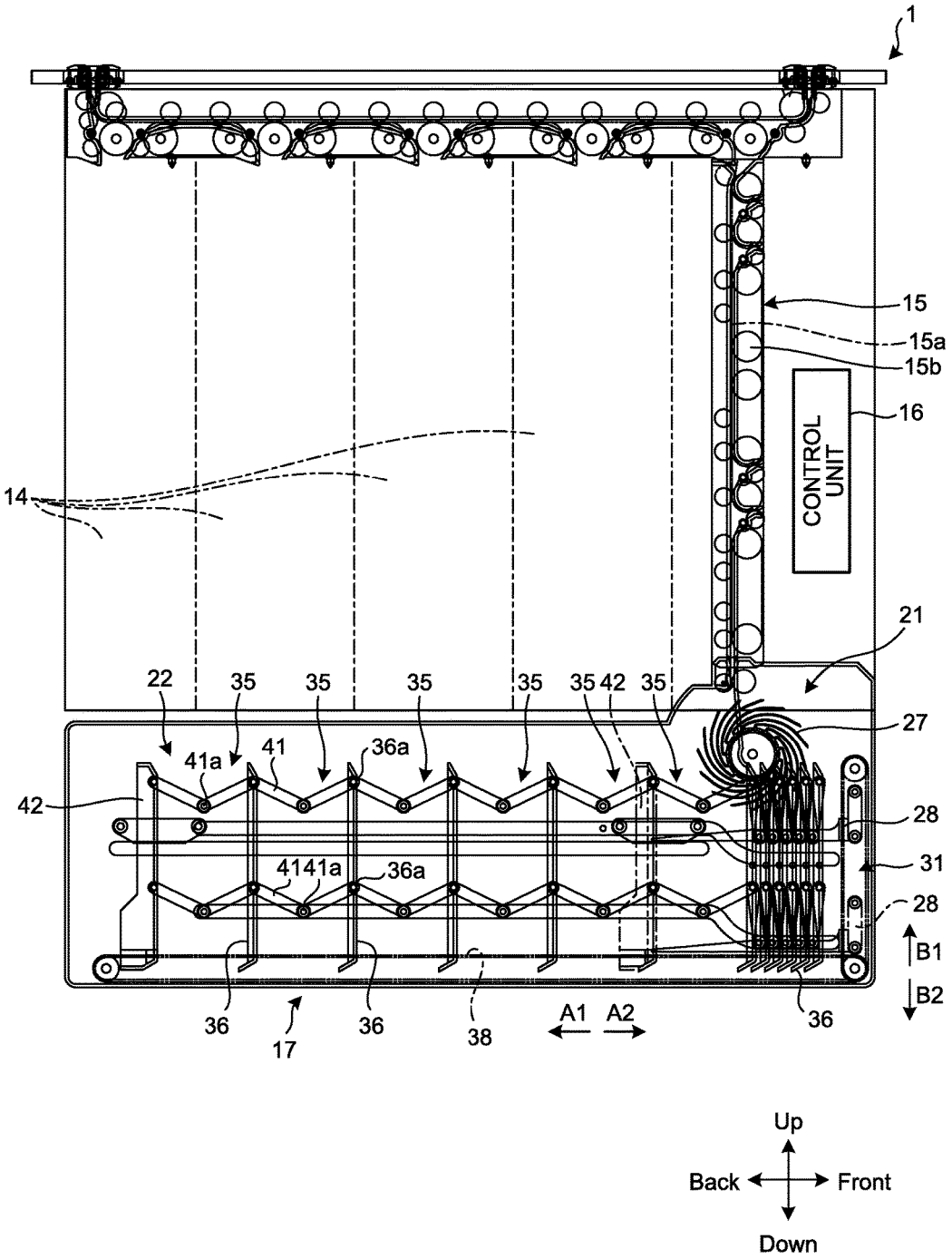
FIG. 2 is a perspective side view illustrating a main part of the banknote handling apparatus of the embodiment.
Figure 3A:
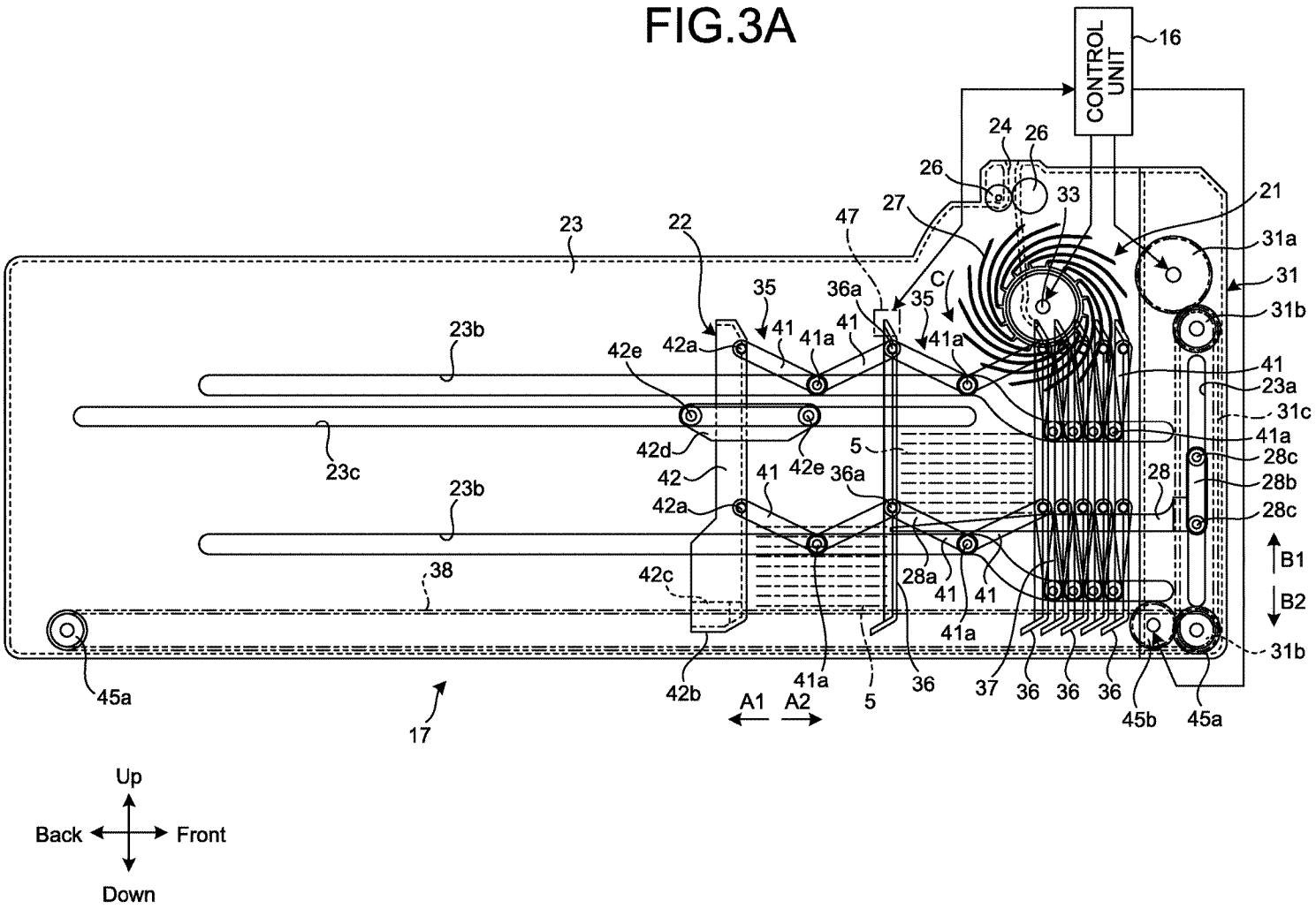
FIG. 3A is a perspective side view illustrating the banknote storage apparatus of the embodiment.
Figure 3B:
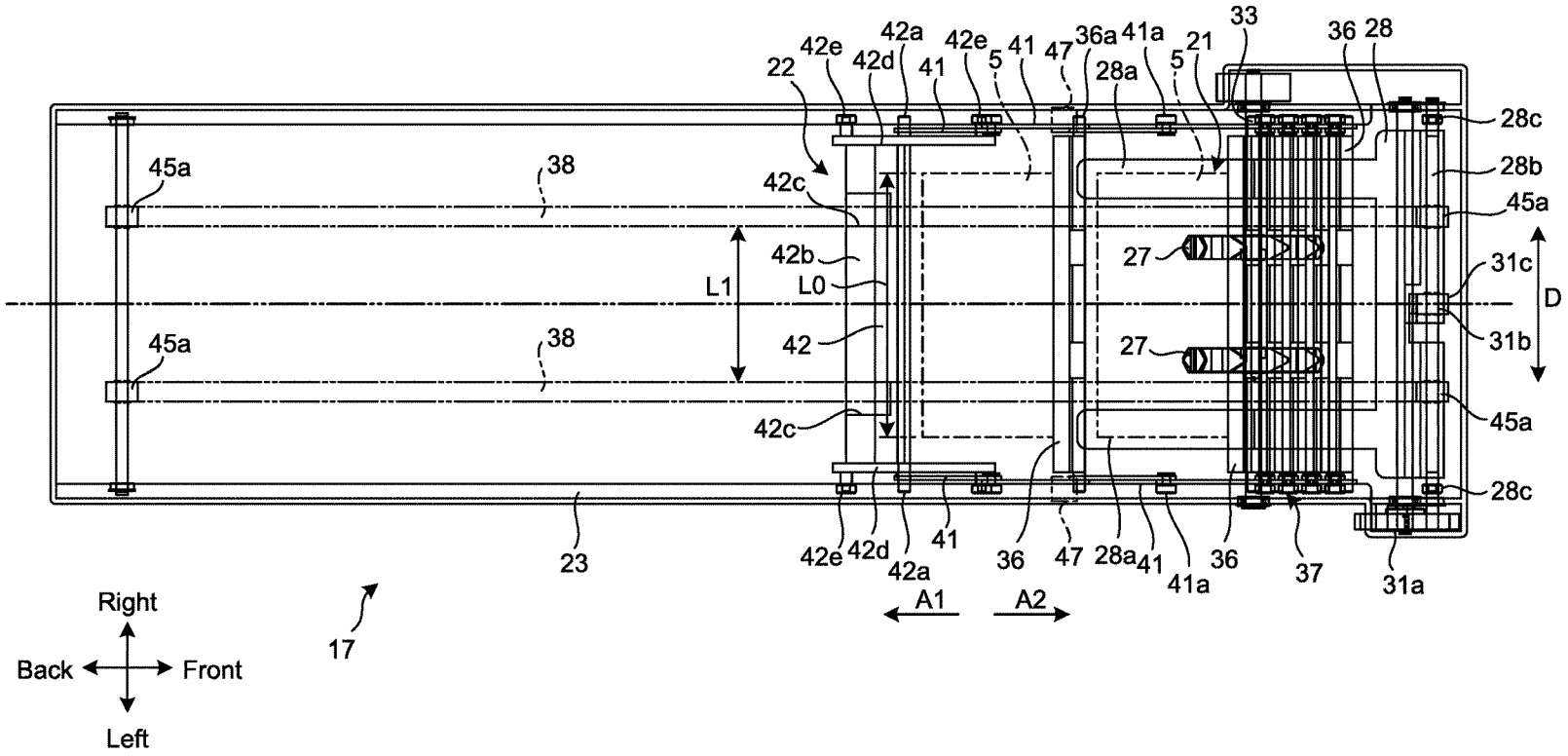
FIG. 3B is a perspective plan view illustrating the banknote storage apparatus of the embodiment.
Figure 3C:
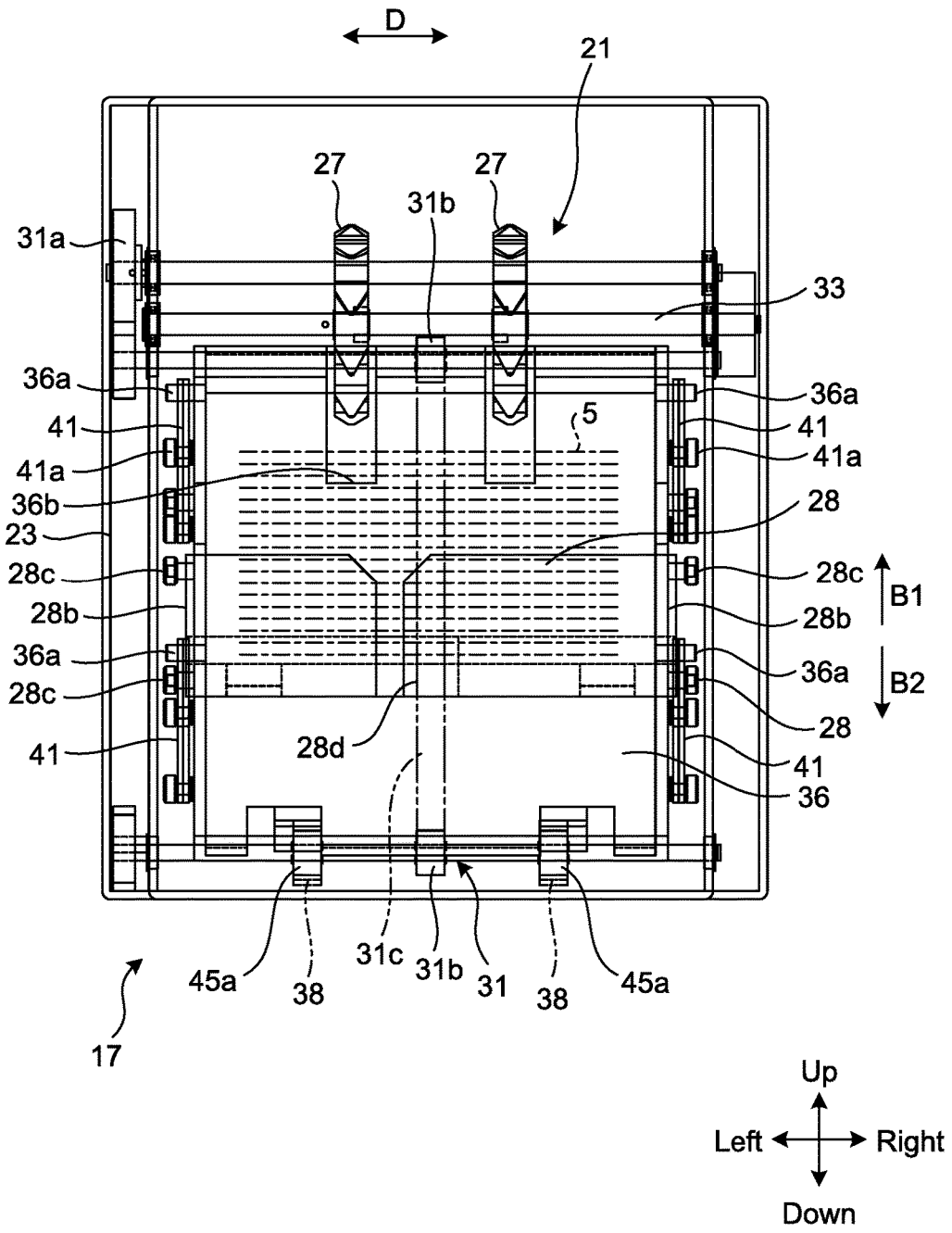
FIG. 3C is a perspective front view illustrating the banknote storage apparatus of the embodiment.

FIG. 2 is a perspective side view illustrating a main part of the banknote storage apparatus 17 of the embodiment. FIG. 3A is a perspective side view illustrating the banknote storage apparatus 17 of the embodiment. FIG. 3B is a perspective plan view illustrating the banknote storage apparatus 17 of the embodiment. FIG. 3C is a perspective front view illustrating the banknote storage apparatus 17 of the embodiment.

As illustrated in FIG. 1 and FIG. 2, the banknote storage apparatus 17 of the embodiment is arranged at the bottom (bottom layer) of the banknote handling apparatus 1 so as to extend from the front side (the receipt/payment unit 11 side) of the banknote handling apparatus 1 toward the back side thereof, i.e., toward A1 and A2 directions being the depth direction of the banknote handling apparatus 1. Thereby, the depth and height of the inner space of the banknote storage apparatus 17 can be sufficiently secured, and the workability, when the banknotes 5 stored in the inner space are collected, can be secured without any restriction due to the dimensions of the banknote handling apparatus 1 as compared with the case, where the banknote storage apparatus 17 is arranged in the front side or in the back side.

As illustrated in FIG. 3A to FIG. 3C, the banknote storage apparatus 17 includes an alignment mechanism 21 as a carry-in mechanism that carries in banknotes 5, a storage mechanism 22 that has a plurality of storage spaces 35 in which the banknotes 5 are stored by the alignment mechanism 21, and a chassis 23 that supports the alignment mechanism 21 and the storage mechanism 22. The alignment mechanism 21 and the storage mechanism 22 are arranged inside the chassis 23. A carry-in port 24 through which the banknotes 5 conveyed by the conveying unit 15 are carried in, is provided in the upper side of the chassis 23.

The alignment mechanism 21 and the storage mechanism 22 are controlled by the controller 16. In the present embodiment, the banknote storage apparatus 17 and the controller 16 are formed separately, but it may be configured so that the banknote storage apparatus 17 has the controller 16 or so that the banknote storage apparatus 17 itself has a control circuit for controlling the banknote storage apparatus 17 instead of the controller 16.

Configuration of Alignment Mechanism

The alignment mechanism 21 includes a carry-in roller 26 that carries in the banknotes 5 sent from the housing units 14 to the carry-in port 24, a pair of impellers 27 that convey the banknotes 5 carried in by the carry-in roller 26, and a placing table 28 on which the banknotes 5, conveyed by the pair of impellers 27, are stacked and placed. The alignment mechanism 21 also includes a lifting mechanism 31 that moves the placing table 28 up and down along B1 and B2 directions (see FIG. 3A) with respect to the storage spaces 35 which is included in the storage mechanism 22.

As illustrated in FIG. 3A, the alignment mechanism 21 is disposed to face one storage space 35 newly fed out by the storage mechanism 22, which is explained later. The alignment mechanism 21 carries the banknotes 5 in the storage spaces 35 in the order that the storage mechanism 22 feeds out the storage space 35.

As illustrated in FIG. 3A, the carry-in roller 26 is provided near the carry-in port 24 of the chassis 23. The impeller 27 is supported by a rotating shaft 33 and is arranged rotatably in the C direction below the carry-in port 24. As illustrated in FIG. 3B and FIG. 3C, the pair of impellers 27 are arranged at a predetermined interval with respect to the axial direction of the rotating shaft 33 so as to correspond to the both sides in the long-side direction of the banknote 5, and are rotatably driven by a drive motor (not illustrated). The impeller 27 rotates while housing the banknote 5 carried in through the carry-in port 24 between adjacent blades, thereby conveying the banknotes downward.

Figure 4A:
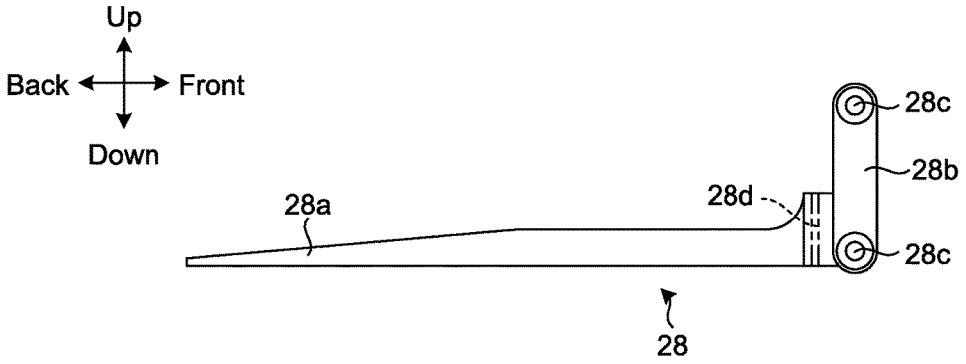
FIG. 4A is a side view illustrating a placing table of an alignment mechanism of the embodiment.
Figure 4B:
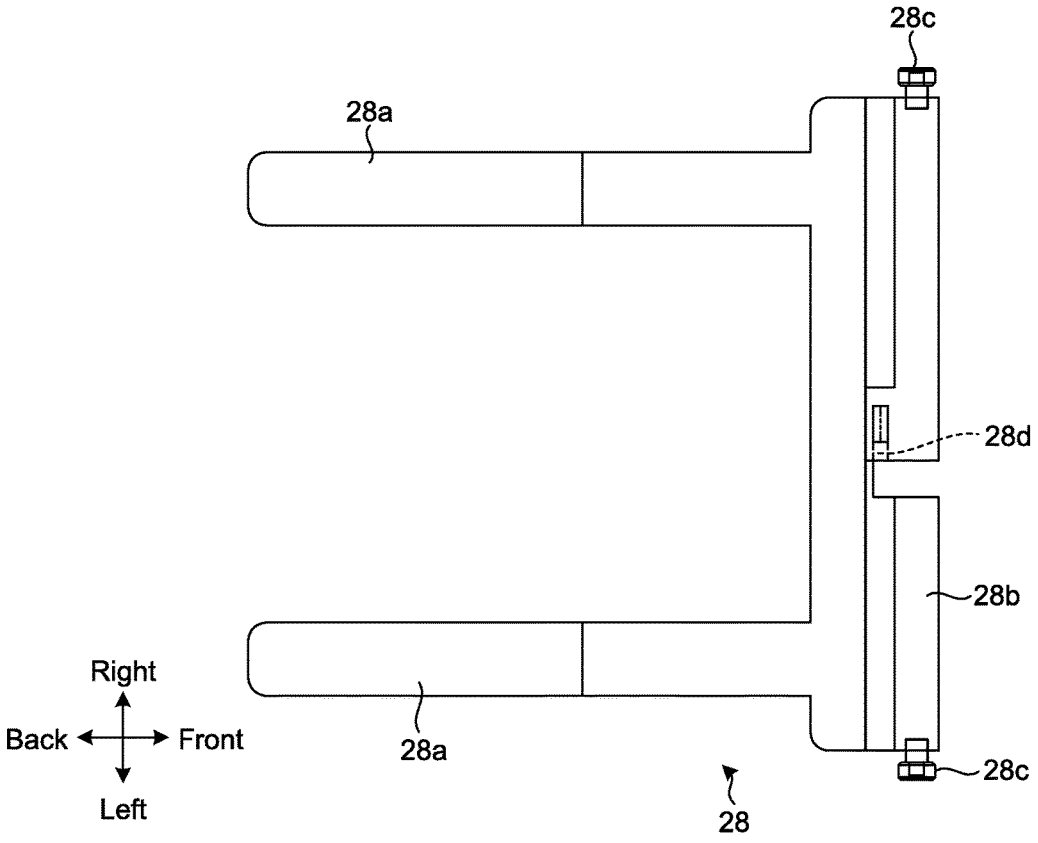
FIG. 4B is a plan view illustrating the placing table of the alignment mechanism of the embodiment.
Figure 4C:
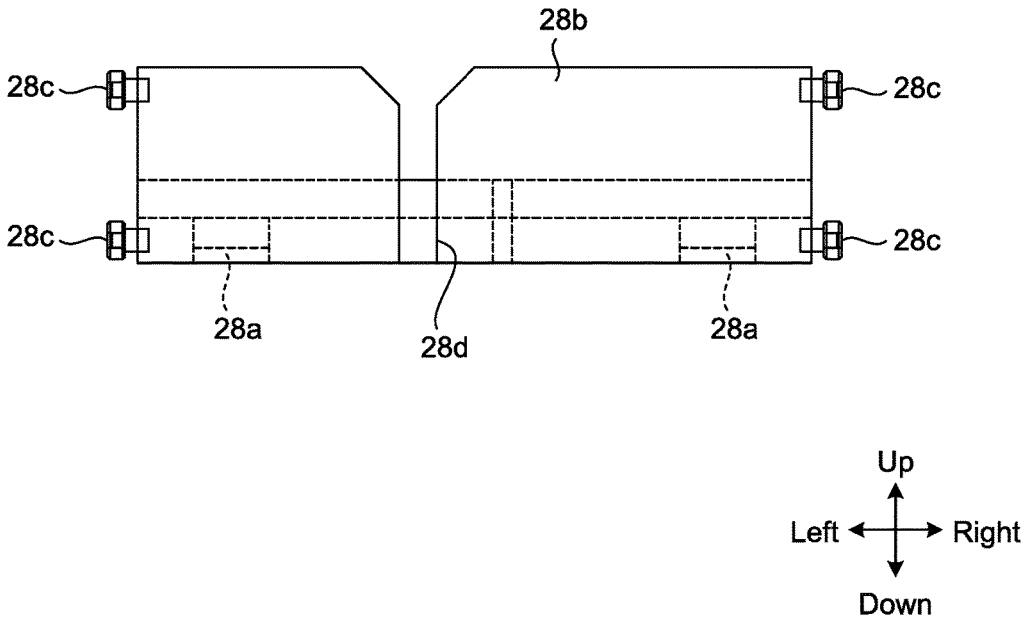
FIG. 4C is a front view illustrating the placing table of the alignment mechanism of the embodiment.

FIG. 4A is a side view illustrating the placing table 28 of the alignment mechanism 21 in the banknote storage apparatus 17 of the embodiment. FIG. 4B is a plan view illustrating the placing table 28 of the alignment mechanism 21 in the banknote storage apparatus 17 of the embodiment. FIG. 4C is a front view illustrating the placing table 28 of the alignment mechanism 21 in the banknote storage apparatus 17 of the embodiment.

As illustrated in FIG. 3A to FIG. 3C and FIG. 4A to FIG. 4C, the placing table 28 is formed in a tray shape and has a pair of placing portions 28*a* on which both sides in the long-side direction of the banknote 5 are placed. Slide portions 28*b*, which is supported by the side surface of the chassis 23, are respectively provided on the both sides of the placing table 28 in the D direction (FIG. 3B). Each of the slide portions 28*b* is provided with a guide shaft 28*c*, which is supported movably along the B1 and B2 directions on the side surface of the chassis 23. As illustrated in FIG. 4B, the slide portion 28*b* is provided with a connecting groove 28*d*, which is connected with the lifting mechanism 31.

On the other hand, as illustrated in FIG. 3A, a lifting guide slit 23*a* for guiding the slide portion 28*b* of the placing table 28, is formed along the B1 and B2 directions, and the slide portion 28*b* of the placing table 28 is arranged movably along inside of the lifting guide slit 23*a*. Therefore, the placing table 28 is supported on the side surface of the chassis 23 with the placing portions 28*a* in a posture parallel to the horizontal direction.

As illustrated in FIG. 3A to FIG. 3C, the lifting mechanism 31 includes a gear 31*a* driven by a drive motor (not illustrated), a pair of pulleys 31*b* rotated by the gear 31*a*, and a lifting belt 31*c* wound around the pair of pulleys 31*b* along the B1 and B2 directions. The lifting belt 31*c* is connected to the connecting groove 28*d* of the placing table 28 to move the placing table 28 with respect to the B1 and B2 directions.

The conveying unit 15 according to the embodiment conveys the banknote 5 with the short-side direction of the rectangular banknote 5 in parallel to the conveying direction. Therefore, the banknote 5, which is conveyed along the short-side direction of the banknote 5, is carried in through the carry-in port 24 from vertically upper side of the carry-in port 24, and the alignment mechanism 21 causes the banknotes 5, which is carried in from the carry-in port 24, to align on the placing table 28. The banknotes 5 aligned on the placing table 28 causes the long-side direction of the banknote 5 to be in parallel to the horizontal direction and to align in their stacked state along the A1 and A2 directions in the banknote storage apparatus 17. In this way, the alignment mechanism 21 can suppress the banknotes 5, which is carried into the banknote storage apparatus 17, from being disordered, and store the banknotes 5 properly in the storage space 35 provided in the storage mechanism 22.

The alignment mechanism 21 according to the present embodiment causes the impellers 27 to rotate to thereby sequentially stack the banknotes 5 on the placing table 28 toward the A1 direction, so that the banknotes 5 are aligned on the placing table 28. The direction, in which the banknotes 5 are stacked in order on the placing table 28, is not limited to the order toward the A1 direction, and the banknotes 5 may be stacked in order toward the A2 direction.

The placing table 28 is controlled by the controller 16 so that the height with respect to the carry-in port 24, i.e., the relative position to the impellers 27 is changed according to the external dimensions of the banknote 5, which is carried in through the carry-in port 24. Thus, the alignment mechanism 21 can properly place the banknotes 5 on the placing table 28, which makes it possible to suppress the occurrence of a jam that the banknotes 5 are clogged on the placing table 28.

The alignment mechanism 21 includes a full sensor (not illustrated) for detecting that the placing table 28 is full of the banknotes 5 stacked on the placing table 28. For example, when the banknotes 5 are to be sequentially stacked on the placing table 28 toward the A1 direction, the full sensor is arranged on one end in the A1 direction of the placing table 28. As the full sensor, for example, an optical sensor, which has a light emitting portion for emitting detection light and a light receiving portion for receiving detection light, is used. The full sensor detects that the placing table 28 is full of the banknotes 5 when the banknote 5, which is placed on the one end in the A1 direction of the placing table 28, blocks the detection light.

The banknote handling apparatus 1 can detect that the placing table 28 is full of the banknotes 5 by causing, instead of using the full sensor, the controller 16 to count the number of banknotes 5 carried into the banknote storage apparatus 17 and to store the counted value in a semiconductor memory or the like. Then, when it is detected that the placing table 28 is full of the banknotes 5, the alignment mechanism 21 stores the banknotes 5 stacked on the placing table 28 in the storage space 35 of the storage mechanism 22.

Configuration of Storage Mechanism

As illustrated in FIG. 3A to 3C, the storage mechanism 22 has a plurality of storage spaces 35 in which the banknotes 5 are stored, and continuously feeds out the storage spaces 35 toward the A1 direction, which is one direction, while forming the storage spaces 35 one by one. The storage mechanism 22 includes a plurality of partition members 36 for partitioning the storage spaces 35, and a link mechanism 37 for linking the partition members 36 so as to be tightly attached to each other in the A1 and A2 directions and for moving the partition members 36 in the A1 direction one by one. The storage mechanism 22 also includes a pair of drive belts 38 that drive the link mechanism 37 and that work as a placing member for placing thereon the banknotes 5, which are carried in the storage spaces 35.

Figure 5A:
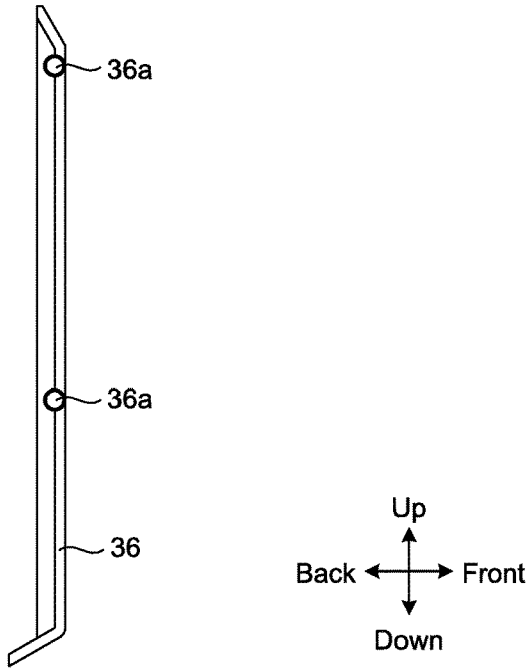
FIG. 5A is a side view illustrating a partition member of the storage mechanism of the embodiment.
Figure 5B:
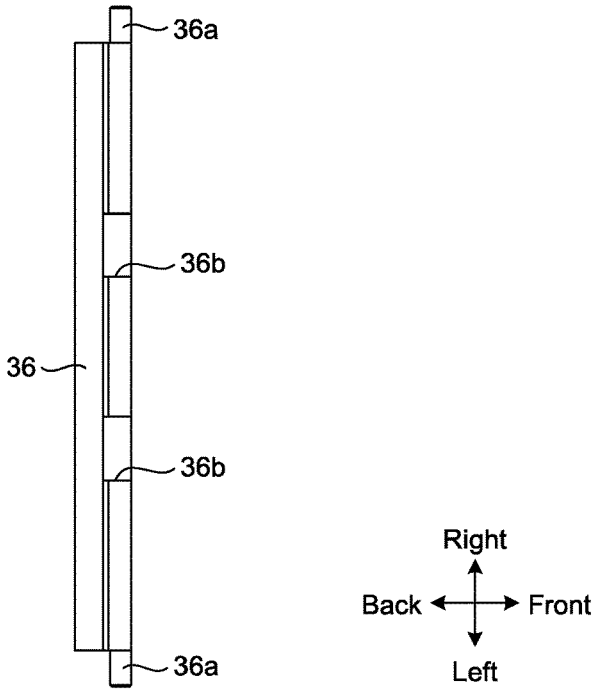
FIG. 5B is a plan view illustrating the partition member of the storage mechanism of the embodiment.
Figure 5C:
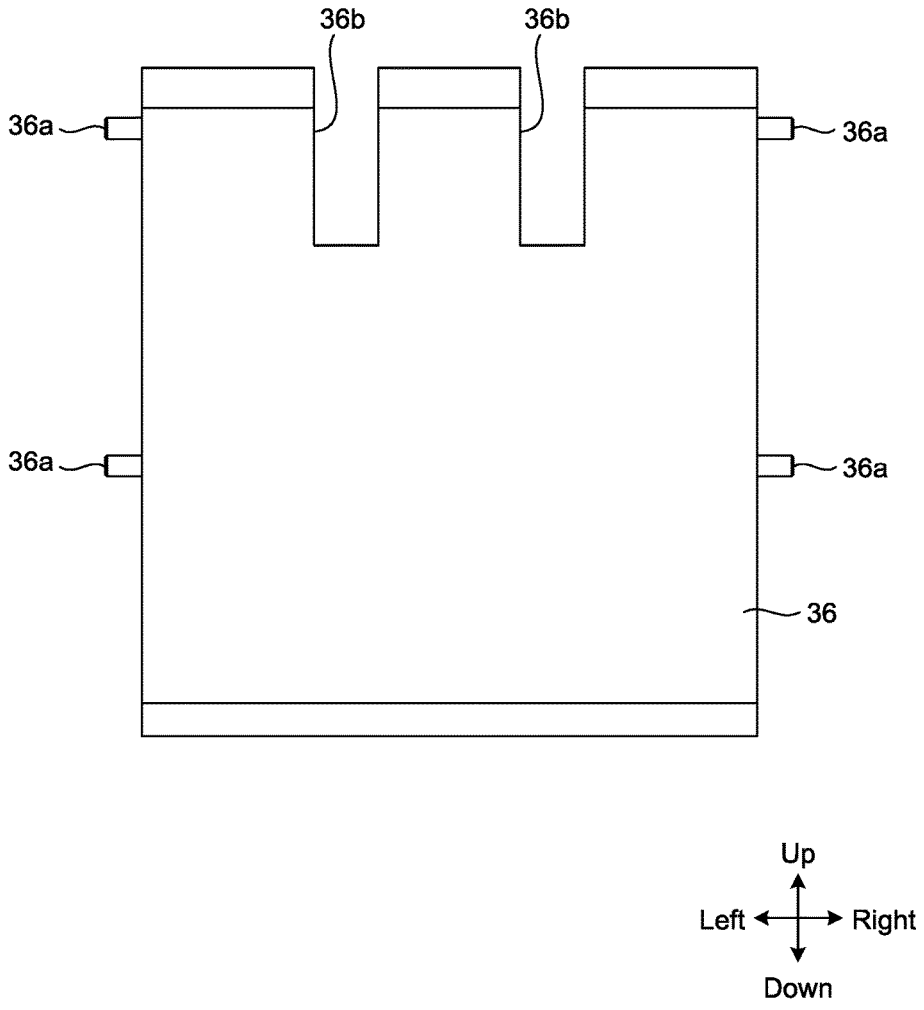
FIG. 5C is a front view illustrating the partition member of the storage mechanism of the embodiment.

FIG. 5A is a side view illustrating the partition member 36 of the storage mechanism 22 in the banknote storage apparatus 17 of the embodiment. FIG. 5B is a plan view illustrating the partition member 36 of the storage mechanism 22 in the banknote storage apparatus 17 of the embodiment. FIG. 5C is a front view illustrating the partition member 36 of the storage mechanism 22 in the banknote storage apparatus 17 of the embodiment.

As illustrated in FIG. 3A to 3C and FIG. 5A to FIG. 5C, the partition members 36 are formed in a plate shape so that they can be tightly attached to each other. One pair of upper and lower connecting shafts 36*a* connected to the link mechanism 37, are provided on the partition member 36 on both sides in the D direction along the shaft direction of the impeller 27. As illustrated in FIG. 3A, the partition member 36 is supported by the link mechanism 37 via the connecting shafts 36*a* in an upright posture in the vertical direction. As illustrated in FIGS. 3C and 5C, slits 36*b* where the pair of impellers 27 are rotatably arranged, are formed on the upper edge of the partition member 36. The adjacent partition members 36 are used as partition walls, which constitutes the storage space 35 in a space that the partition members 36 face each other by making a predetermined interval with respect to the A1 and A2 directions.

As illustrated in FIG. 3A and FIG. 3B, the link mechanism 37 provided in the storage mechanism 22, includes a plurality of link members 41 connected in a zigzag manner, and a link actuating member 42 that moves the link members 41.

The link members 41 are formed in a line shape, and end portions of a pair of adjacent link members 41 are rotatably connected via a guide shaft 41*a*. The other ends of both sides of the pair of link members 41, whose one ends are connected via the guide shaft 41*a*, are respectively connected to the connecting shafts 36*a* of the adjacent partition members 36. As illustrated in FIG. 3A, in the pair of link members 41 positioned at the head of the A1 direction side, the other end of the one link member 41, one end of which is connected to the guide shaft 41*a*, is connected to the connecting shaft 36*a* of the partition member 36, and the other end of the other link member 41, one end of which is connected to the guide shaft 41*a*, is connected to a connecting shaft 42*a*, explained later, provided in the link actuating member 42.

Therefore, the link members 41 are alternately connected to the guide shaft 41*a* and the connecting shaft 36*a* of the partition member 36, and are configured so as to be extendable in the A1 and A2 directions. Two rows of the link members 41 connected in this manner are arranged on the upper and lower sides respectively on both sides in the D direction. Therefore, because the partition members 36 are fed out at given intervals in the A1 direction by each link member 41, the storage spaces 35 are equally created at the given intervals each between the adjacent partition members 36.

A plurality of link guide slits 23*b* for guiding the guide shafts 41*a* each connecting the link members 41, are formed extending in the A1 and A2 directions on the side surface of the chassis 23, and the guide shaft 41*a* of the connected link members 41 is arranged movably along inside of the link guide slit 23*b*.

The link guide slit 23*b* horizontally extends toward the A1 direction side and the end portion thereof on the A2 direction side is formed in a stepped shape that includes inclination with respect to the horizontal direction (A1 and A2 directions). For this reason, when the guide shaft 41*a* of the link members 41, connected to each other, moves in the A2 direction along the link guide slit 23*b*, the position of the guide shaft 41*a* changes in the B2 direction. As a result, each of the link members 41 is folded in an upright posture with respect to the vertical direction (B1 and B2 directions).

Figure 6A:
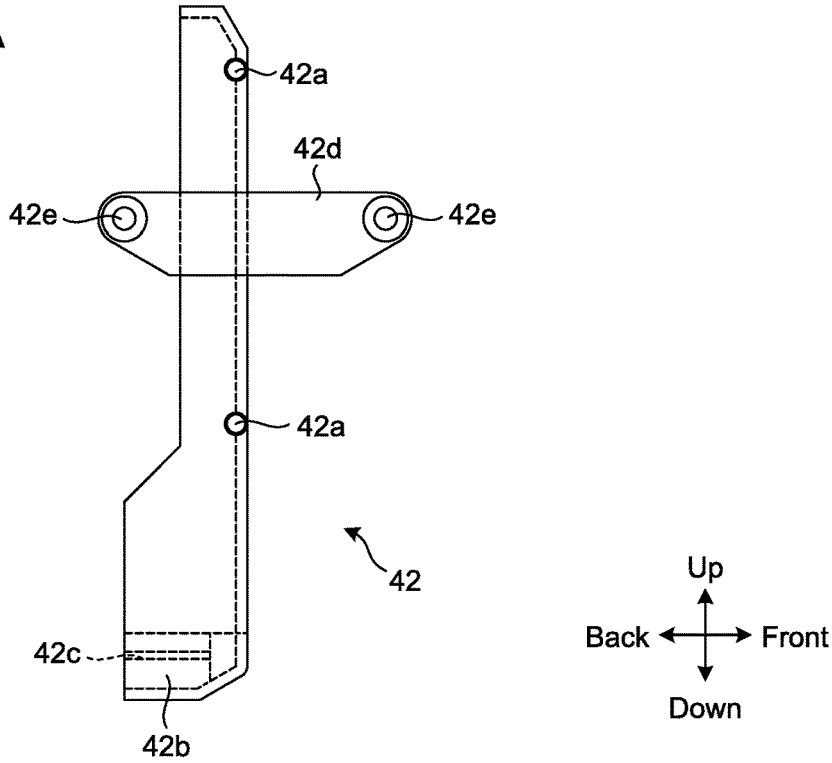
FIG. 6A is a side view illustrating a link actuating member of the storage mechanism of the embodiment.
Figure 6B:
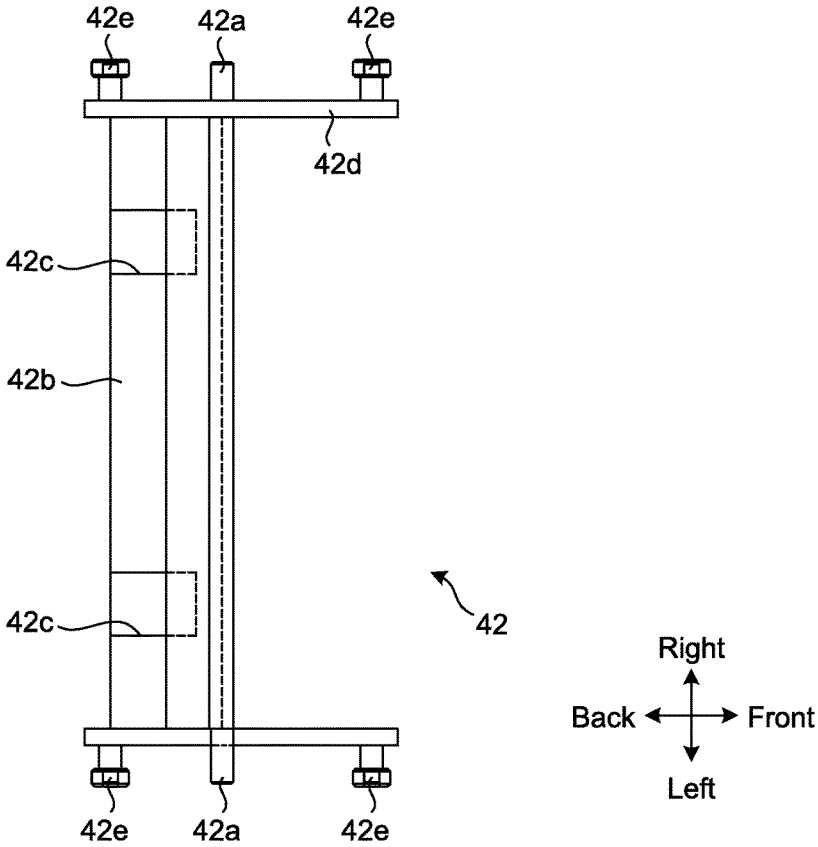
FIG. 6B is a plan view illustrating the link actuating member of the storage mechanism of the embodiment.
Figure 6C:
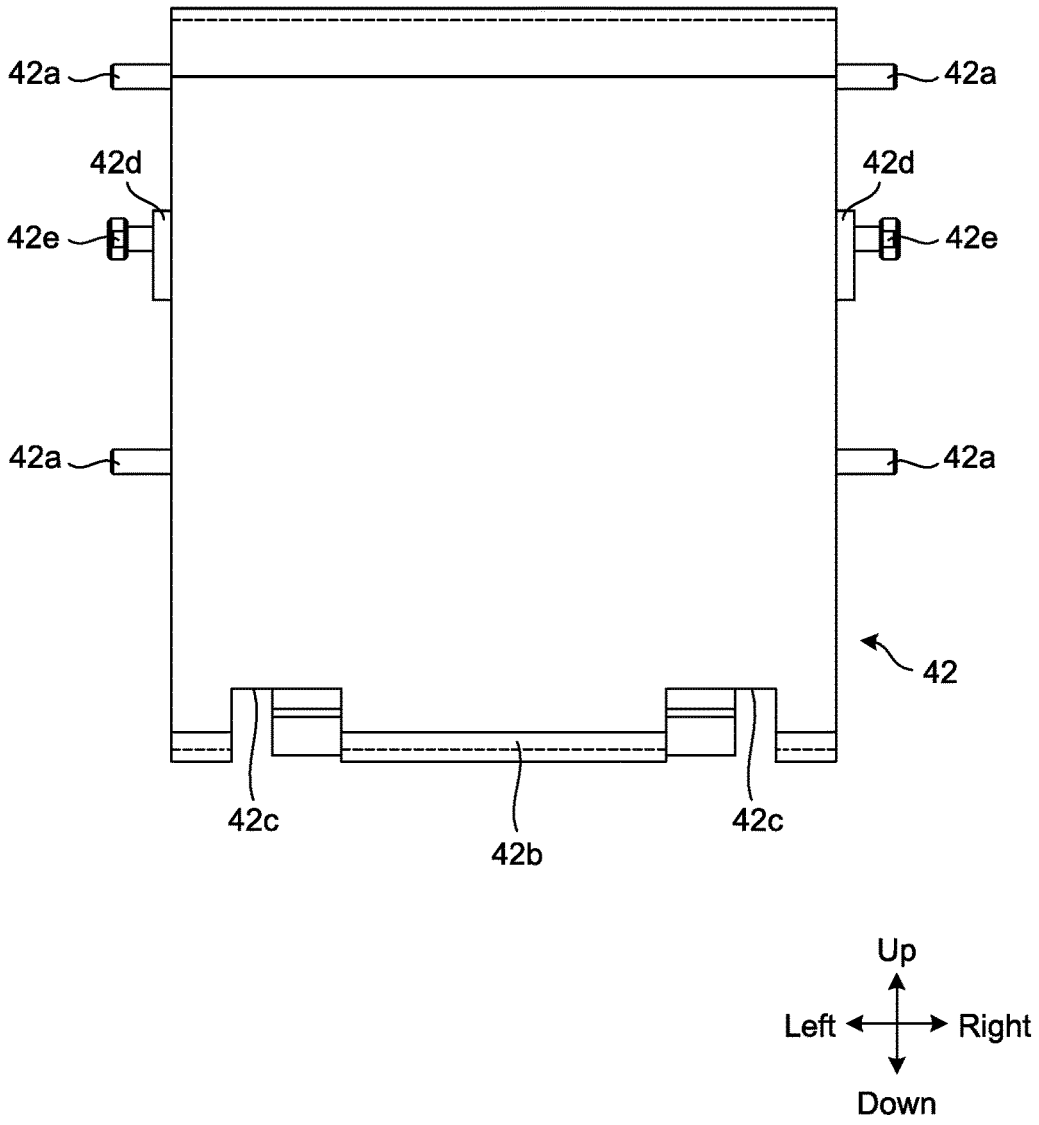
FIG. 6C is a front view illustrating the link actuating member of the storage mechanism of the embodiment.

FIG. 6A is a side view illustrating the link actuating member 42 of the storage mechanism 22 in the banknote storage apparatus 17 of the embodiment. FIG. 6B is a plan view illustrating the link actuating member 42 of the storage mechanism 22 in the banknote storage apparatus 17 of the embodiment. FIG. 6C is a front view illustrating the link actuating member 42 of the storage mechanism 22 in the banknote storage apparatus 17 of the embodiment.

As illustrated in FIG. 3A, FIG. 3B, and FIG. 6A to FIG. 6C, the link actuating member 42 is formed in a shape capable of being tightly attached to the partition member 36 in the A1 and A2 directions. One pair of upper and lower connecting shafts 42*a* connected to the other end portions of the link members 41, are provided on both sides of the link actuating member 42 in the D direction. The link actuating member 42 has a connecting portion 42*b* that is connected to the pair of drive belts 38, and the drive belts 38 are fixed to connecting grooves 42*c* that is formed on the connecting portion 42*b*.

Slide portions 42*d*, which are supported on the side surface of the chassis 23, are respectively provided on the both sides of the link actuating member 42 in the D direction (FIG. 3B). Each of the slide portions 42*d* is provided with guide shafts 42*e* that are supported movably along the A1 and A2 directions on the side surface of the chassis 23. On the other hand, a slide guide slit 23*c* for guiding the guide shafts 42*e* of the link actuating member 42, is formed on the side surface of the chassis 23 along the A1 and A2 directions, and the guide shafts 42*e* of the link actuating member 42, are arranged movably along inside of the slide guide slit 23*c*.

The guide shafts 42*e*, which are driven by the drive belts 38, move along the slide guide slit 23*c*, so that the link actuating member 42 moves with respect to the A1 and A2 directions. The link actuating member 42 moves in the A1 direction to thereby extend the connected link members 41 in the A1 direction and spread the link mechanism 37. The link mechanism 37 is spread to thereby feed out the partition members 36 one by one in the A1 direction together with the moving link members 41. As a result, the link mechanism 37 forms the storage spaces 35 one by one between the link actuating member 42 and the partition member 36 and between adjacent partition members 36.

On the other hand, the link actuating member 42 moves in the A2 direction, thereby shrinking the connected link members 41 in the A2 direction and folding the link mechanism 37. The link mechanism 37 is folded to thereby cause the storage space 35 between the link actuating member 42 and the partition member 36 and between the adjacent storage spaces 35 to disappear. In this way, the link actuating member 42 functions also as a partition wall that constitutes the storage space 35 similarly to the partition member 36 in the head of the A1 direction (feeding-out direction).

The pair of drive belts 38 are wound around a pair of pulleys 45*a* along the A1 and A2 directions. One of the pulleys 45*a* is rotated via a gear 45*b* that is driven by a drive motor (not illustrated).

In addition, as illustrated in FIG. 3B, the pair of drive belts 38 are arranged at a predetermined interval L1 where both sides of the banknote 5 in the long-side direction are placed, and also function as placing members on which the banknotes 5, stored in the storage space 35, are placed. The interval L1 of the pair of drive belts 38 is made shorter than a length L0 in the long-side direction of the banknote 5, so that the both sides in the long-side direction of the banknote 5 can be placed on the drive belts 38.

As illustrated in FIG. 3A and FIG. 3B, the storage mechanism 22 has a position sensor 47 as a detector that detects a position of the partition member 36. The position sensor 47 is arranged so as to face a position where the partition members 36 are fed out one by one by the link mechanism 37. As the position sensor 47, for example, an optical sensor, which has a light emitting portion for emitting detection light toward the partition member 36 and a light receiving portion for receiving detection light emitted from the light emitting portion, is used. When the partition member 36, fed out in the A1 direction, blocks the detection light, the position sensor 47 detects that the partition member 36 is in a predetermined position.

Storing Operation of Banknote Storage Apparatus

Regarding the banknote storage apparatus 17 configured in the above manner, operations of the alignment mechanism 21 and the storage mechanism 22 at the time of storing the banknotes 5, will be explained with reference to the drawings.

Figure 7A:
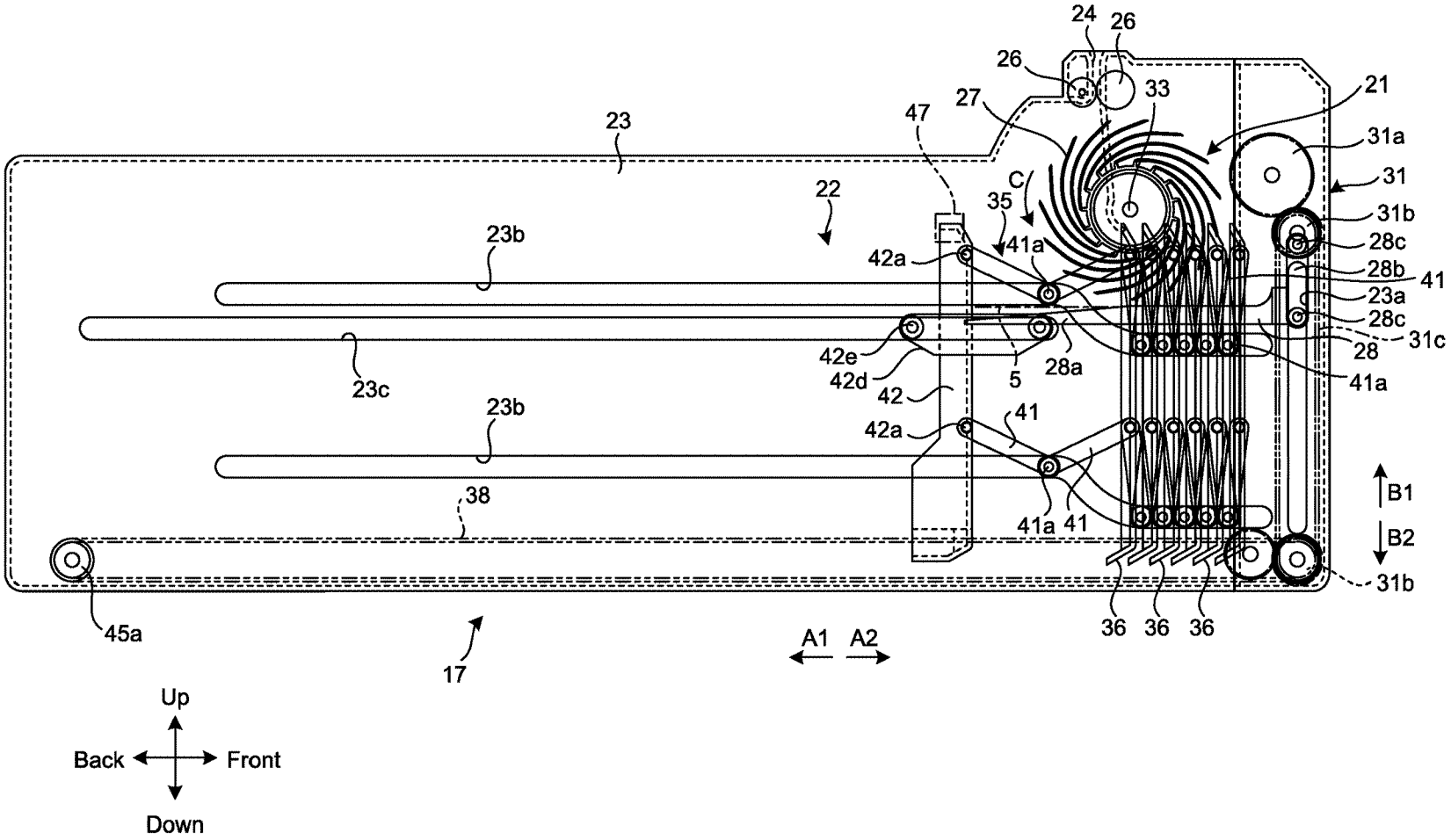
FIG. 7A is a perspective side view illustrating a state in which the carried-in banknotes are placed on the placing table in the banknote storage apparatus of the embodiment.
Figure 7B:
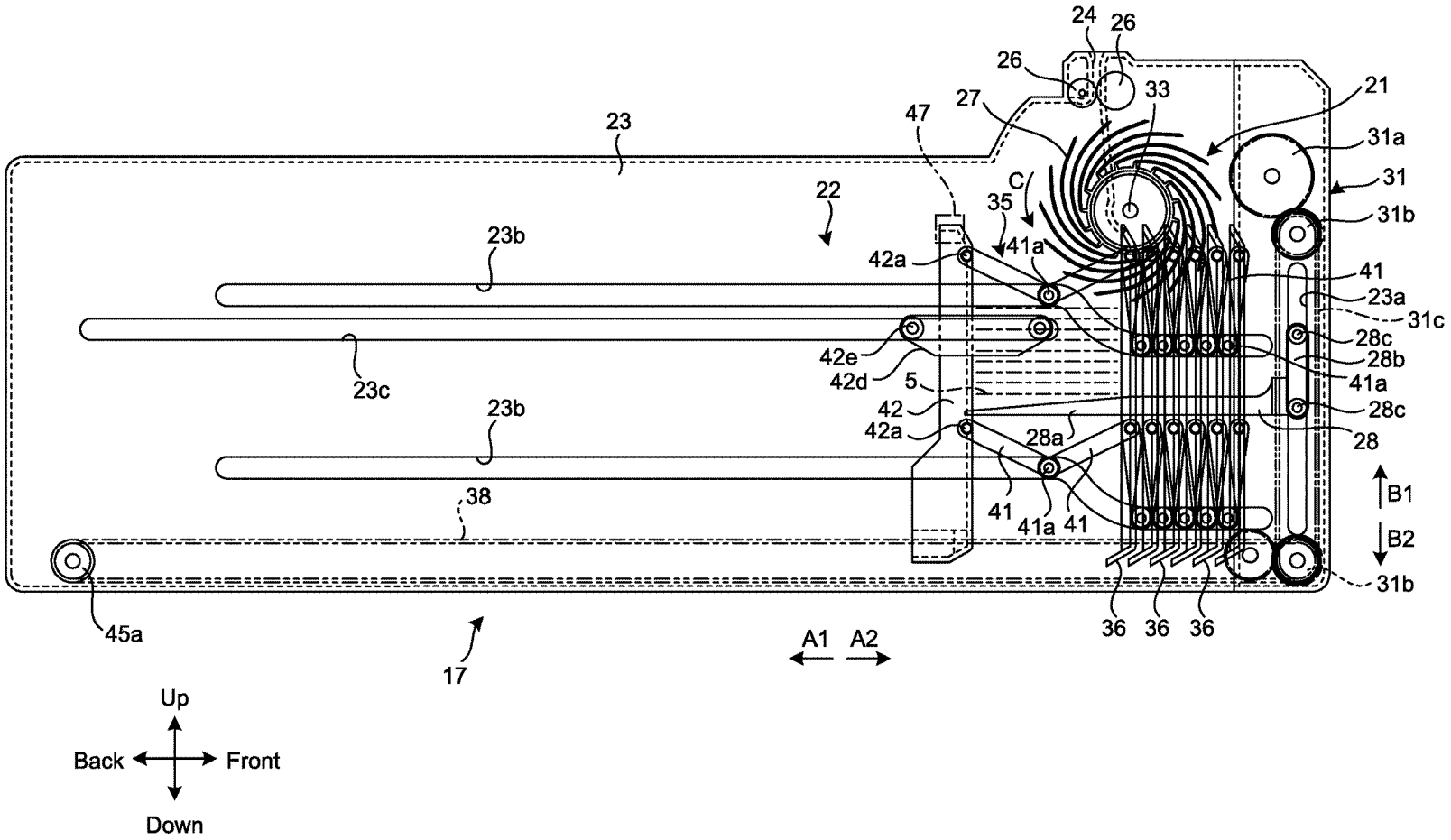
FIG. 7B is a perspective side view illustrating a state in which the placing table on which the banknotes are placed is moved down in the banknote storage apparatus of the embodiment.
Figure 7C:
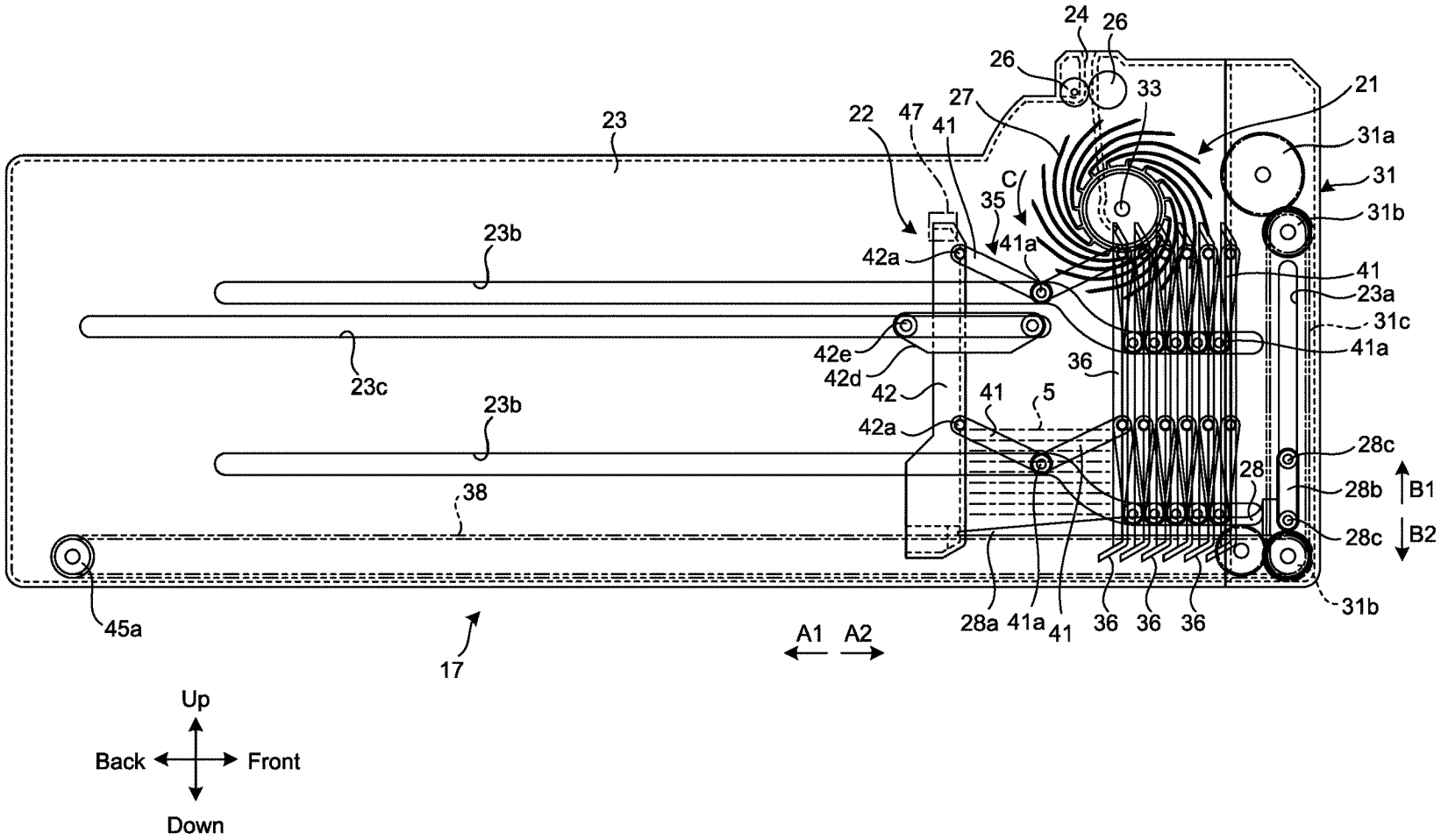
FIG. 7C is a perspective side view illustrating a state in which the banknotes placed on the placing table are stored in the storage space in the banknote storage apparatus of the embodiment.
Figure 7D:
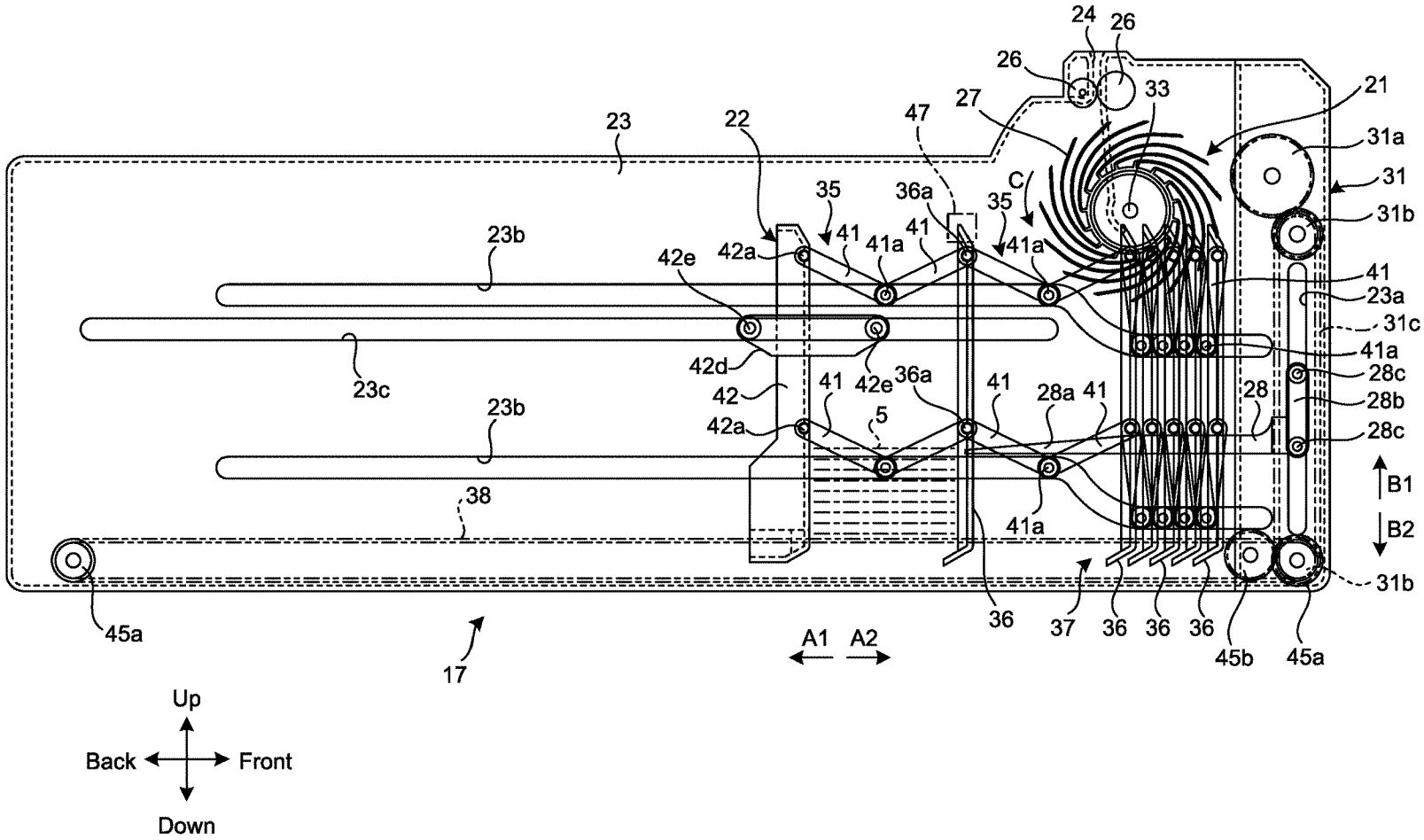
FIG. 7D is a perspective side view illustrating a state in which the storage space with the banknotes stored therein is fed and a next storage space is fed out in the banknote storage apparatus of the embodiment.
Figure 7E:
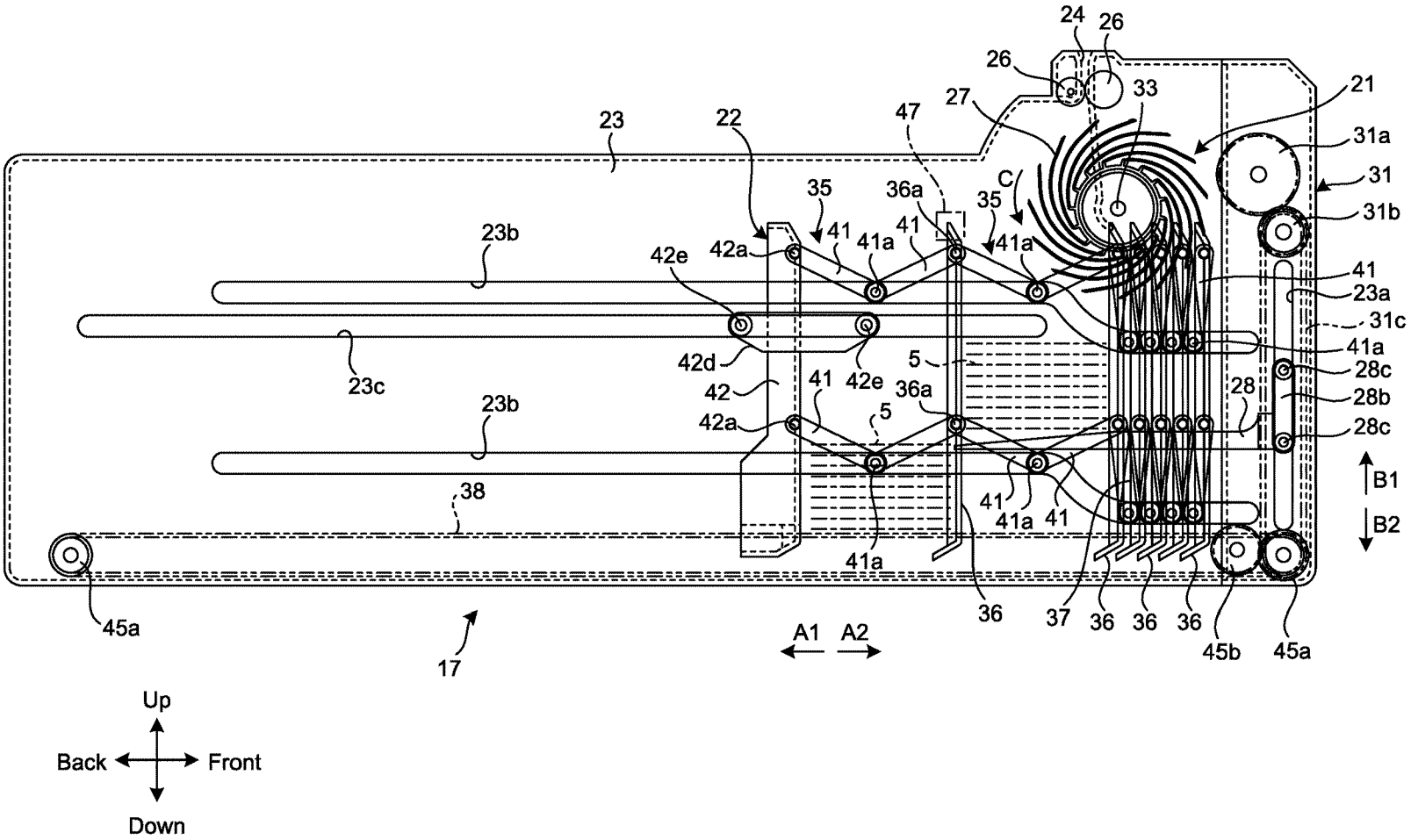
FIG. 7E is a perspective side view illustrating a state in which the banknotes are placed on the placing table in the next storage space in the banknote storage apparatus of the embodiment.
Figure 7F:
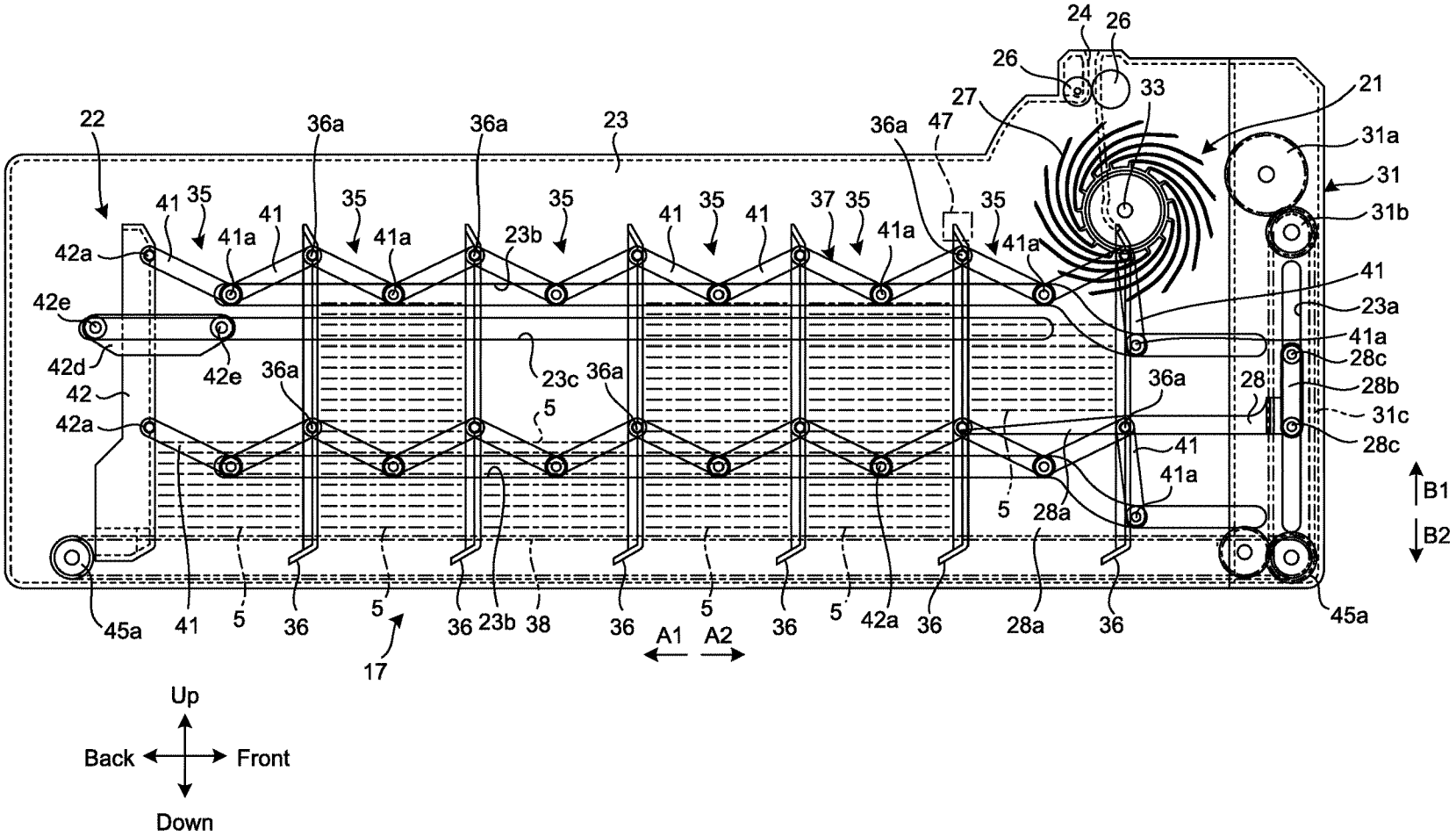
FIG. 7F is a perspective side view illustrating a state in which the banknotes are stored in the respective storage spaces in the banknote storage apparatus of the embodiment.
Figure 8:
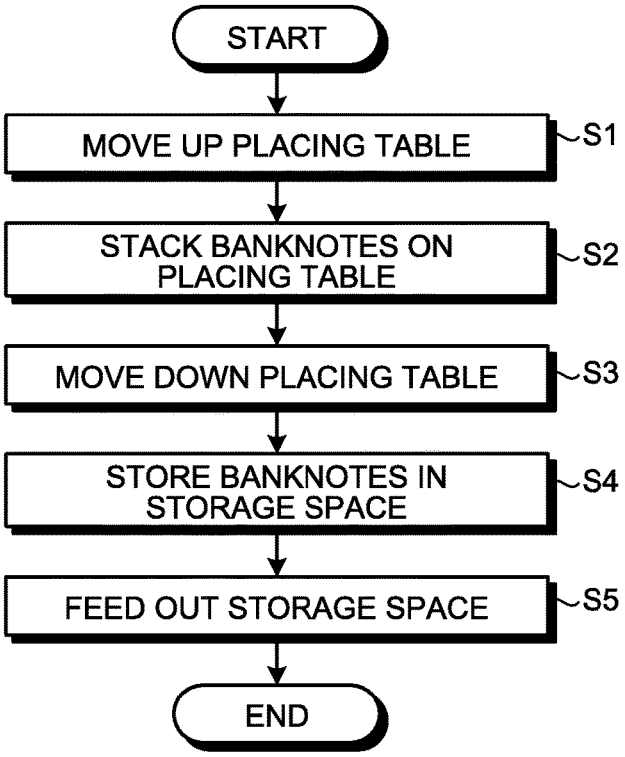
FIG. 8 is a flowchart for explaining operations of the alignment mechanism and the storage mechanism in the banknote storage apparatus of the embodiment.

FIG. 7A is a perspective side view illustrating a state in which the carried-in banknotes 5 are placed on the placing table 28 in the banknote storage apparatus of the embodiment. FIG. 7B is a perspective side view illustrating a state in which the placing table 28 on which the banknotes 5 are placed is moved down in the banknote storage apparatus 17 of the embodiment. FIG. 7C is a perspective side view illustrating a state in which the banknotes 5 placed on the placing table 28 are stored in the storage space 35 in the banknote storage apparatus 17 of the embodiment. FIG. 7D is a perspective side view illustrating a state in which the storage space 35 with the banknotes stored therein is fed and a next storage space 35 is fed out in the banknote storage apparatus 17 of the embodiment. FIG. 7E is a perspective side view illustrating a state in which the banknotes 5 are placed on the placing table 28 in the next storage space 35 in the banknote storage apparatus 17 of the embodiment. FIG. 7F is a perspective side view illustrating a state in which the banknotes 5 are stored respectively in the storage spaces 35 in the banknote storage apparatus 17 of the embodiment. FIG. 8 is a flowchart for explaining operations of the alignment mechanism 21 and the storage mechanism 22 in the banknote storage apparatus 17 of the embodiment.

First of all, the banknote storage apparatus 17 moves the link actuating member 42 in the A1 direction by driving the drive belts 38 of the storage mechanism 22. The storage mechanism 22 creates the storage space 35 between the link actuating member 42, which is moved in the A1 direction, and the leading partition member 36 in the A1 direction. The placing table 28 of the alignment mechanism 21 is located inside the storage space 35, and the placing table 28 is moved up and down in the storage space 35 by the lifting mechanism 31 of the alignment mechanism 21.

FIG. 7A is a diagram illustrating a state in which a first storage space 35 is opened and banknotes 5 are started to be fed into the storage space 35, and FIG. 7B is a diagram illustrating a state in which the banknotes 5 are staked in the storage space 35. As illustrated in FIG. 7A, FIG. 7B, and FIG. 8, the banknote storage apparatus 17 causes the lifting mechanism 31 of the alignment mechanism 21 to move up the placing table 28 in the B1 direction (Step S1 in FIG. 8). At this time, the controller 16 controls the alignment mechanism 21, so that the height in the B1 and B2 directions of the placing table 28 with respect to the carry-in port 24, becomes appropriate according to the external dimensions of the banknote 5, which is fed from the housing unit 14. Thereby, the placing table 28 is moved to the position where the banknotes 5 can be properly stacked.

Subsequently, as illustrated in FIG. 7A and FIG. 7B, the banknote storage apparatus 17 causes the impellers 27 of the alignment mechanism 21 to rotate, and thereby conveys the banknotes 5, which are carried in from the carry-in port 24, and stacks the banknotes 5 on the placing portions 28*a* of the placing table 28 toward the A1 direction (Step S2 in FIG. 8). In the banknote storage apparatus 17, the alignment mechanism 21 continuously stacks the banknotes 5 on the placing table 28, and the controller 16 temporarily stops the rotation of the impellers 27 when the number of the banknotes 5, which are stacked on the placing table 28, reaches a predetermined number.

Then, as illustrated in FIG. 7C and FIG. 8, the banknote storage apparatus 17 causes the lifting mechanism 31 of the alignment mechanism 21 to move down the placing table 28 in the B2 direction (Step S3 in FIG. 8). At this time, the banknote storage apparatus 17 moves the placing portions 28*a* of the placing table 28 to a position lower than the height of the drive belts 38 of the storage mechanism 22, thereby placing the banknotes 5, which are placed on the placing portions 28*a*, on the pair of drive belts 38. As a result, the banknote storage apparatus 17 carries the stacked banknotes 5 into the storage space 35 from the placing table 28, on which the banknote 5 are stacked, and stores the banknotes 5 in the storage space 35 (Step S4 in FIG. 8).

Subsequently, as illustrated in FIG. 7D and FIG. 8, the banknote storage apparatus 17 moves the link actuating member 42 in the A1 direction and feeds out the leading partition member 36 in the A1 direction via the link mechanism 37. As a result, the banknote storage apparatus 17 feeds the storage space 35 where the banknotes 5 are stored in the A1 direction, and moves the partition member 36, thereby feeding out the next storage space 35 (Step S5 in FIG. 8).

Thereafter, as illustrated in FIG. 7E and FIG. 8, the banknote storage apparatus 17 causes the lifting mechanism 31 of the alignment mechanism 21 to move up the placing table 28 in the B1 direction in the newly fed-out storage space 35 (Step S1), and stacks the banknotes 5 on the placing table 28 that is positioned at the appropriate height (Step S2). Thereafter, the banknote storage apparatus 17 causes the alignment mechanism 21 and the storage mechanism 22 to repeat the carry-in operation and the storing operation of the banknotes 5, thereby storing the banknotes 5 in the stacked state in the respective storage spaces 35 fed out in the A1 direction as illustrated in FIG. 7F and FIG. 8. Then, the banknotes 5 stored in the storage spaces 35 are collected by a user from, for example, a collection port (not illustrated) that is openably/closably provided in the chassis 23.

Here, regarding the storage spaces 35 to be fed out one by one in the A1 direction, they are referred to as a first storage space 35, a second storage space 35, . . . an n-th storage space 35 sequentially from the A1 direction side. Similarly, regarding the partition members 36 to be fed out one by one in the A1 direction, they are referred to as a first partition member 36, a second partition member 36, . . . an n-th partition member 36 sequentially from the A1 direction side.

At this time, the first storage space 35 is created between the link actuating member 42 and the partition member 36 on the drive belts 38. The second storage space 35 is created between the first partition member 36 and the second partition member 36 on the drive belts 38. The third storage space 35 is created between the second partition member 36 and the third partition member 36 on the drive belts 38. Therefore, the n-th partition member 36 is created between the (n−1)-th partition member 36 and the n-th partition member 36 on the drive belts 38. In this way, the banknote storage apparatus 17 can feed out a plurality of storage spaces 35 one by one onto the drive belts 38 by the number of partition members 36 that is provided in the storage mechanism 22.

The controller 16 controls each housing unit 14 so as to convey the banknotes 5 from the housing units 14 to the banknote storage apparatus 17, based on the denomination of the banknote 5, and it is thereby possible to store, for example, the banknotes 5 that are classified for each denomination in each storage space 35. This allows the banknote storage apparatus 17 to collect the banknotes 5 that are classified for each denomination. In this case, for example, by conveying the banknotes 5, which are classified for each denomination, from the housing unit 14 to the banknote storage apparatus 17, storing the banknotes 5 of one denomination in the first storage space 35, and thereafter feeding out the second storage space 35, the banknotes 5 of other denomination are stored in the second storage space 35.

When the banknotes 5 are to be classified based on denominations and stored in the storage spaces 35, the banknote storage apparatus 17 may be configured so as to have a plurality types of storage spaces 35 with different sizes by setting different intervals between the partition members 36. According to this configuration, it is possible to store the banknotes 5 in a storage space 35 with an appropriate size corresponding to the dimensions of the denomination of the banknote 5, thus it is possible to stably store the plurality types of the banknotes 5 in the storage spaces 35.

By moving the link actuating member 42 in the A2 direction after the banknotes 5 are collected from the storage spaces 35, the banknote storage apparatus 17 folds the partition members 36 together with the link members 41, so that the storage spaces 35 are returned to the state that is ready to be fed out.

In the present embodiment, although all the storage spaces 35 from the first storage space 35 to the n-th storage space 35, are fed out for use in the inner space of the banknote storage apparatus 17, the embodiment is not limited to such a storing operation. In the banknote storage apparatus 17, by folding the link mechanism 37 and tightly attaching the partition members 36 to each other, the state, where no storage space 35, is created, i.e., the state, where the storage space 35 is lost, is maintained. For this reason, the controller 16 can also control so as to feed out arbitrarily the required number of storage spaces 35 according to the size of the inner space capable of feeding out the storage spaces 35 in the banknote storage apparatus 17. Therefore, for example, in a plurality of types of banknote handling apparatuses with different depth dimensions with respect to the A1 and A2 directions, it is possible to share the banknote storage apparatus 17 and it can be easily applied to the types of banknote handling apparatuses.

Although the alignment mechanism 21 according to the present embodiment is configured so as to store the banknotes 5 sequentially from the first storage space 35 to the n-th storage space 35 at the position where the storage mechanism 22 feeds out the first storage space 35, the embodiment is not limited to the positions of the impellers 27 and the placing table 28 with respect to the A1 and A2 directions. For example, the alignment mechanism 21 may be configured so as to store the banknotes 5 sequentially from the first storage space 35 to the n-th storage space 35 at a position that faces the first storage space 35, which is fed in the A1 direction when the storage mechanism 22 feeds out the second storage space 35.

In the storing method of the banknote storage apparatus 17 configured as described above, the storage space 35 is continuously fed out in the A1 direction while creating a plurality of storage spaces 35 one by one and the banknotes 5 are carried into the storage spaces 35 in the order of feeding out the storage space 35. In the storing method of the banknote storage apparatus 17, the banknotes 5 are stacked and the stacked banknotes 5 are carried into the storage space 35.

The banknote storage apparatus 17 of the embodiment includes the storage mechanism 22 that continuously feeds out the storage spaces 35 in one direction while a plurality of storage spaces 35, which store the banknotes 5, are created one by one. In the banknote storage apparatus 17, when the storage mechanism 22 feeds out the storage spaces 35 one by one, the storage mechanism 22 plays a part of the function of carrying in the banknotes 5 by feeding the storage space 35 where the banknotes 5 are stored, so that it is possible to simplify the carry-in mechanism and a carry-in path for carrying the banknotes 5 into the storage spaces 35. As a result, in the banknote storage apparatus 17, it is possible to reduce the space occupied by the carry-in mechanism and the carry-in path, to make effective use of the inner space in the banknote storage apparatus 17 as the storage spaces 35, and to efficiently store the banknotes 5 in the inner space.

The banknote storage apparatus 17 of the embodiment includes the alignment mechanism 21 that carries the banknotes 5 in the storage spaces 35 in the order that the storage mechanism 22 feeds out the storage space 35, and the controller 16 that controls the alignment mechanism 21 and the storage mechanism 22. This makes it possible for the alignment mechanism 21 to appropriately carry the banknotes 5 in the respective storage spaces 35. Additionally, in the storing operation of the banknotes 5 in the storage space 35, because the carry-in operation of the banknotes 5 by the alignment mechanism 21, is simply stopped only when the storage mechanism 22 feeds out the storage space 35, it is possible to reduce the stop time of the storing operation and is possible to shorten the time required for storage. Moreover, because a single alignment mechanism 21 can carry the banknotes 5 in the plurality of storage spaces 35, the carry-in mechanism and the carry-in path can be simplified. Therefore, it is possible to make effective use of the inner space of the banknote storage apparatus 17 as the storage spaces 35 and is possible to efficiently store the banknotes 5 in the inner space.

The storage mechanism 22 in the banknote storage apparatus 17 of the embodiment includes the plurality of partition members 36, the link mechanism 37 that moves the partition members 36 one by one in the A1 direction, and the drive belts 38 that places thereon the banknotes 5, which is carried in the storage spaces 35. Thereby, it is possible to simplify the configuration of the storage mechanism 22 for feeding out the storage spaces 35 and is possible to suppress the increase in driving force for driving the storage mechanism 22.

The alignment mechanism 21 in the banknote storage apparatus 17 of the embodiment includes the impellers 27 that convey the banknotes 5, and the placing table 28 that stacks and places the banknotes 5, which are conveyed by the impellers 27. By stacking the banknotes 5 on the placing table 28 in this way, it is possible to suppress the occurrence of a jam that the banknotes 5 are clogged when the banknotes 5 are conveyed to the storage spaces 35 and is possible to stably carry the banknotes 5 into the storage spaces 35.

The alignment mechanism 21 in the banknote storage apparatus 17 of the embodiment includes the lifting mechanism 31 that moves the placing table 28 up and down with respect to the storage space 35, and the lifting mechanism 31 carries the banknotes 5 stacked on the placing table 28 into the storage space 35. Thereby, it is possible to appropriately and smoothly store the banknotes 5, which are carried in from the upper side in the vertical direction of the storage space 35 in the storage space 35. In addition, the banknotes 5, which are stacked on the placing table 28, can be carried into the storage space 35 in their stacked state.

The controller 16 in the banknote handling apparatus 1 of the embodiment controls the storage mechanism 22 so as to feed out each of the storage spaces 35 to the same position with respect to the carry-in port 24 into which the banknote 5 is carried. Thereby, it is possible to keep the relative position between the carry-in port 24 and the storage space 35 constant, and the state, in which the banknotes 5 are carried into the storage space 35, becomes constant, so that the stability of the carry-in operation can be enhanced.

The controller 16 in the banknote handling apparatus 1 of the embodiment controls the storage mechanism 22 so as to classify the plurality of types of banknotes 5 based on the types and store the classified banknotes 5 into the plurality of storage spaces 35. Thereby, it is possible to store the banknotes 5 that are classified for each denomination in the respective storage spaces 35.

The storage mechanism 22 in the banknote storage apparatus 17 of the embodiment includes the position sensor 47 that detects the position of the partition member 36, which is moved by the link mechanism 37. The controller 16 controls the storage mechanism 22 so as to feed out the partition member 36 to a predetermined position based on the detection result of the position sensor 47. Thereby, it is possible to enhance the position accuracy of the storage spaces 35, which are fed out one by one by the storage mechanism 22, and is possible to more stably store the banknotes 5 in the storage spaces 35.

The controller 16 in the banknote handling apparatus 1 of the embodiment controls the alignment mechanism 21 so as to change the position of the placing table 28 with respect to the impellers 27 according to the dimensions of a carried-in banknote 5. Thereby, it is possible to move the height of the placing table 28 to an appropriate position according to the dimensions of the banknote 5, which are carried by the impeller 27, and is possible to stably stack the banknotes 5 on the placing table 28.

The banknote handling apparatus 1 of the embodiment can effectively utilize the space with respect to the depth direction (A1 and A2 directions) of the banknote handling apparatus 1 by arranging the banknote storage apparatus 17 at the bottom of the entire apparatus, so that it is possible to secure a large storage space 35 of the banknote storage apparatus 17. When the banknotes 5 stored in the banknote handling apparatus 1 are to be collected, it is also possible to collect the banknotes 5 without hindering the banknote handling process of the banknote handling apparatus 1 and is possible to appropriately secure the workability when collecting the banknotes 5.

Although the banknote storage apparatus 17 of the embodiment is configured so that the banknotes 5 on the placing table 28 or in the storage space 35 are stacked in the horizontal direction (A1 and A2 directions), the direction, in which the banknotes 5 are stacked, is not limited. It may also be configured so that the banknotes 5 are stacked on the placing table 28 or in the storage space 35 in the vertical direction (B1 and B2 directions).

Although the banknote storage apparatus 17 of the embodiment is configured so that the alignment mechanism 21 has the lifting mechanism 31 that moves the placing table 28 up and down, the embodiment does not limit the configuration of the alignment mechanism 21. The banknote storage apparatus 17 may be configured so that the banknotes 5, which are conveyed by the impellers 27 of the alignment mechanism 21, are directly stored in the storage space 35.

Although the banknote storage apparatus 17 of the embodiment is configured so that the banknotes 5 are carried in from the carry-in port 24 that is arranged vertically upward, the embodiment does not limit the carry-in direction of the banknotes 5. For example, it may be configured so that the banknotes 5, which are carried in along the horizontal direction, are stacked on the placing table 28 by the impellers 27.

According to one aspect of the paper sheet storage apparatus disclosed in the present application, paper sheets can be efficiently stored in the inner space of the paper sheet storage apparatus.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet storage apparatus comprising:

a storage mechanism that includes a plurality of storage spaces where paper sheets are stored, and continuously feeds out the storage spaces toward one direction while creating the storage spaces one by one;

a carry-in mechanism that carries the paper sheets into the storage spaces in the order that the storage mechanism feeds out the storage spaces; and a controller that controls the carry-in mechanism and the storage mechanism, wherein the storage mechanism includes:

partition members that partition the storage spaces, respectively;

a link mechanism that causes the partition members to connect each other so as to be tightly attached to each other in the one direction and that moves the partition members one by one in the one direction; and a placing member that places thereon the paper sheets carried in the respective storage spaces, and the carry-in mechanism includes:

an impeller that conveys the paper sheets; and a placing table that stacks and places thereon the paper sheets conveyed by the impeller.

2. The paper sheet storage apparatus according to claim 1, wherein the carry-in mechanism includes a lifting mechanism that moves the placing table up and down with respect to the storage spaces, and the lifting mechanism carries the paper sheets stacked on the placing table into the storage spaces.

3. The paper sheet storage apparatus according to claim 1, wherein the controller controls the storage mechanism so that the storage spaces are fed out in sequence to a position corresponding to a carry-in port through which the paper sheets are carried in.

4. The paper sheet storage apparatus according to claim 1, wherein the storage mechanism includes a detector that detects a position of a partition member of the partition members moved by the link mechanism, and the controller controls the storage mechanism so as to feed out the partition member to a predetermined position based on the detection result of the detector.

5. A storing method of a paper sheet storage apparatus comprising:

by using the paper sheet storage apparatus, continuously feeding out a plurality of storage spaces in one direction while creating the storage spaces one by one; and carrying paper sheets into the storage spaces in order of feeding out the respective storage spaces, the paper sheet storage apparatus comprising:

a storage mechanism that includes the storage spaces where the paper sheets are stored, and continuously feeds out the storage spaces toward one direction while creating the storage spaces one by one;

a carry-in mechanism that carries the paper sheets into the storage spaces in the order that the storage mechanism feeds out the storage spaces; and a controller that controls the carry-in mechanism and the storage mechanism, wherein the storage mechanism includes:

partition members that partition the storage spaces, respectively;

a link mechanism that causes the partition members to connect each other so as to be tightly attached to each other in the one direction and that moves the partition members one by one in the one direction; and a placing member that places thereon the paper sheets carried in the respective storage spaces, and the carry-in mechanism includes:

an impeller that conveys the paper sheets; and a placing table that stacks and places thereon the paper sheets conveyed by the impeller.

6. The storing method of a paper sheet storage apparatus according to claim 5, further comprising:

stacking the paper sheets; and carrying the stacked paper sheets on the placing table into the respective storage spaces.

* * * * *